US006369791B1

(12) United States Patent
Kudo et al.

(10) Patent No.: US 6,369,791 B1
(45) Date of Patent: Apr. 9, 2002

(54) LIQUID CRYSTAL DISPLAY AND DRIVING METHOD THEREFOR

(75) Inventors: Yasuyuki Kudo, Yokohama; Tatsuhiro Inuzuka, Odawara; Tsutomu Furuhashi, Yokohama; Toshimitsu Matsudo, Funabashi; Kazunari Kurokawa, Mobara, all of (JP)

(73) Assignees: Hitachi, Ltd., Tokyo; Hitachi Video and Information System, Inc., Yokohama, both of (JP)

( * ) Notice: Subject to any disclaimer, the term of this patent is extended or adjusted under 35 U.S.C. 154(b) by 0 days.

(21) Appl. No.: 09/660,338

(22) Filed: Sep. 12, 2000

Related U.S. Application Data

(63) Continuation of application No. 09/044,224, filed on Mar. 19, 1998, now Pat. No. 6,118,425.

(30) Foreign Application Priority Data

Mar. 19, 1997 (JP) ..... 9-066258
May 14, 1997 (JP) ..... 9-123748

(51) Int. Cl.[7] ..... G06G 3/36
(52) U.S. Cl. ..... 345/100; 345/211
(58) Field of Search ..... 345/92, 94, 95, 345/98, 100, 204, 208, 211

(56) References Cited

U.S. PATENT DOCUMENTS 5,010,326 A 4/1991 Yamazaki et al.
5,398,043 A 3/1995 Takeda et al. ..... 345/94
5,473,338 A 12/1995 Prince et al. ..... 345/58
5,475,397 A 12/1995 Saidi ..... 345/100
5,485,173 A 1/1996 Scheffer et al. ..... 345/100
5,638,088 A 6/1997 Mano et al.

FOREIGN PATENT DOCUMENTS

JP 2-89 1/1990
JP 6-67628 3/1994

OTHER PUBLICATIONS

*Liquid Crystal Display Handbook,* pp. 395–399, ISBN 4–526–02590–9 C 3054, published on Sep. 29, 1989, in Japan (in Japanese).
A. Sakamoto et al., "Driving Method to Reduce Shodowing for STN–LCD Module", *Sharp Technical Journal,* vol. 63, Dec. 1995, pp. 9–13 (in Japanese with English abstract).

*Primary Examiner*—Amare Mengistu
(74) *Attorney, Agent, or Firm*—Antonelli, Terry, Stout & Kraus, LLP

(57) ABSTRACT

A liquid crystal display includes a scanning voltage driver which applies selective scanning voltages to scanning electrodes of a liquid crystal display panel one group of M (an integer of 2 or greater) adjacent scanning electrodes at a time in accordance with M orthogonal function data. A data voltage driver applies to data electrodes of the liquid crystal display panel data voltages selected from M+1 data voltages in accordance with a coincidence number representing a number of coincidences between values of M display data corresponding to the M adjacent scanning electrodes in a current group of scanning electrodes and values of the M orthogonal function data corresponding to the M adjacent scanning electrodes in the current group. The data voltage driver controls a correction period in accordance with a value of a difference between (1) a coincidence number corresponding to the current group of scanning electrodes and (2) a coincidence number corresponding to a previous group of scanning electrodes, and applies to the data electrode during the correction period a corrected data voltage which is equal to a sum of a correction voltage and one of the M+1 data voltages.

7 Claims, 30 Drawing Sheets

| FC \ LC | 1 | 2 | 3 | 4 | 5 | 6 | 7 | 8 |
|---|---|---|---|---|---|---|---|---|
| 1 | a | c | c | d | d | b | b | a |
| 2 | d | b | b | a | a | c | c | d |
| 3 | a | b | b | d | d | c | c | a |
| 4 | d | c | c | a | a | b | b | d |
| 5 | c | a | a | b | b | d | d | c |
| 6 | b | d | d | c | c | a | a | b |
| 7 | b | a | a | c | c | d | d | b |
| 8 | c | d | d | b | b | a | a | c |

LIQUID CRYSTAL DISPLAY AND DRIVING METHOD THEREFOR

CROSS-REFERENCE TO RELATED APPLICATION

This application is a continuation of application Ser. No. 09/044,224 filed on Mar. 19, 1998, now U.S. Pat. No. 6,118,425.

BACKGROUND OF THE INVENTION

The present invention relates to a liquid crystal display (LCD) having a liquid crystal display panel (LCD panel) of a passive matrix display type, and more particularly, relates to a liquid crystal display having little display irregularity in which a plurality of scanning electrodes (rows) of a liquid crystal display panel are simultaneously driven.

As a method of driving a liquid crystal display panel of a passive matrix display type, a voltage averaging method described in "Liquid crystal display handbook" pp. 395–399, ISBN 4-526-02590-9 C 3054, published on Sep. 29, 1989, in Japan (in Japanese), is widely employed. According to the method, scanning electrodes corresponding to a row in the liquid crystal display panel are sequentially selected every one scanning period, a selective scanning voltage is applied, and all of scanning electrodes are scanned during a period of one frame. A data voltage at a level in the positive or negative direction around a non selection scan voltage as a center is applied to data electrodes corresponding to the column of the liquid crystal display panel in accordance with the value of display data. Further, alternating operation in which the polarity of the application voltage is inverted every predetermined time is also performed.

On the other hand, as another method of driving the liquid crystal display having a passive matrix liquid crystal display panel, there is a method of selectively driving a plurality of lines described in Japanese Laid-Open Patent Publication No. 6-67628. In the method, a selective scanning voltage corresponding to an orthogonal function (for example, Walsh function) every plurality of lines is sequentially applied to scanning electrodes corresponding to a row in the liquid crystal display panel. When all of the scanning electrodes are scanned in a period, called a period of one frame, the same operation is repeated. The operation is schematically shown in FIG. 2. FIG. 2 shows a case where the number of lines simultaneously selected is eight. The data voltage corresponding to the number of coincidence of the value of the orthogonal function in the selectively scanned line and the value of display data is applied to the data electrodes corresponding to a column in the liquid crystal display panel.

In the display to which the voltage averaging method is applied, since the levels of application voltages generated by a data driver and a scan driver is shifted close to a selective scanning voltage of the scan driver at the time current alternating operation, output amplitudes are equal. The value VLCD is given as follows by using the number N of scanning electrodes and a positive constant called a bias ratio.

$$VLCD = \left(\sqrt{N+1}\right) \cdot \sqrt{\frac{\sqrt{N}}{2\left(\sqrt{N}-1\right)}} \cdot Voff \tag{1}$$

On the other hand, in a display to which the method of selecting and driving a plurality of lines is applied, output amplitudes Vg and Vf of the data driver and the scan driver are given by using the number m of lines simultaneously selected and the number N of scanning electrodes as follows.

$$Vg = 2\sqrt{m} \cdot \sqrt{\frac{\sqrt{N}}{2\left(\sqrt{N}-1\right)}} \cdot Voff \tag{2}$$

$$Vf = 2\sqrt{\frac{N}{m}} \cdot \sqrt{\frac{\sqrt{N}}{2\left(\sqrt{N}-1\right)}} \cdot Voff \tag{3}$$

In the conventional liquid crystal display driving method, when a specific display pattern is displayed, display irregularity called shadowing occurs in the vertical and lateral directions. The shadowing in the lateral direction occurs since a dielectric constant of the liquid crystal cell at the time of "on" display and that at the time of "off" display are different due to dielectric constant anisotropy of the liquid crystal cell.

Specifically, the dielectric constant of the liquid crystal cell when a voltage is applied ("on") is larger than that when a voltage is not applied ("off"). As the number of liquid crystal cells which are "on" on the scanning electrodes increases, the sum of electrostatic capacity seen from the scanning electrodes increases. Consequently, the scanning electrodes on which the number of liquid crystal cells which are "on" is large become largely weakened each time the selective scanning voltage changes and the effective value of the voltage applied to each liquid crystal cell on the scanning electrode is reduced to a value lower than a desired level. Consequently, for example, as shown in FIG. 9, when a plurality of bars having different lengths are displayed by turning on a plurality of cells on the background where the cells are "off", the effective value of a voltage applied to the liquid crystal cell (difference voltage of a voltage applied to the scanning electrode and a voltage applied to the data electrode) is reduced in the row in which the bar is displayed as compared with a row in which a bar is not displayed. The longer the bar display is, the more the effective value is reduced.

With respect to shadowing in the vertical direction, waveform distortion due to change in the data voltage differs according to display patterns and the effective value of the application voltage in a certain period for determining display is different every column, so that display luminance difference (display irregularity) occurs.

SUMMARY OF THE INVENTION

It is, therefore, an object of the invention to provide a liquid crystal display in which a method of simultaneously driving a plurality of scanning electrodes on a liquid crystal display panel of a passive matrix display type is used and shadowing in the lateral direction due to dielectric constant anisotropy of the liquid crystal cell is reduced.

It is another object of the invention to provide a liquid crystal display and a method of driving a passive matrix liquid crystal, especially, a method of selectively driving a plurality of lines, in which shadowing in the vertical direction due to the difference in waveform distortion of a data voltage can be reduced.

In order to solve the problem, the invention provides a liquid crystal display having a liquid crystal display panel of a passive matrix display type having a plurality of scanning electrodes and a plurality of data electrodes, comprising: scanning electrode driving means for sequentially and simultaneously selecting (m) scanning electrodes (m is an integer of 2 or larger) corresponding to a row as a display target and applying a selective scanning voltage at a level based on a value of an orthogonal function to the scanning electrodes simultaneously selected; data electrode driving means for generating a voltage by which display data in the row can be displayed on the basis of display data of the row of the scanning electrodes simultaneously selected and the value of the orthogonal function used to determine the selective scanning voltage applied to the scanning electrodes, and applying the voltage to the plurality of data electrodes; counting means for obtaining the sum of display data which is "on" among display data in the row of the scanning electrodes simultaneously selected every row; and selective scanning voltage correcting means for correcting the level of the selective scanning voltage applied to the scanning electrodes simultaneously selected so that the reduction in an effective value of a voltage applied to each of liquid crystal cells corresponding to the scanning electrodes on the basis of the sum of display data indicative of display "on" in the row of the scanning electrodes and the value of the orthogonal function used to determine the selective scanning voltage applied to the scanning electrode.

The above problem is solved by a liquid crystal display comprising a liquid crystal display panel in which each of dots is formed at a crossing point of a scanning electrode and a data electrode which cross each other; a scanning electrode driving means for applying selective scanning voltages at two levels having polarities on the positive side and the negative side when a selective un-scanning voltage is used as a center in accordance with values of orthogonal function data every group of scanning electrodes obtained by setting two lines of said scanning electrodes as a set; a data electrode driving means for summing up the numbers of coincidence between a value of display data on each scanning electrode in a group of scanning electrodes to which the selective scanning voltage is applied and a value of orthogonal function data to be supplied to each of the scanning electrodes every group of scanning electrodes and for applying a data voltage according to the sum of coincidence numbers to the data electrode; and power source means for generating a voltage at a level necessary to drive the liquid crystal display panel and a power source voltage of the scanning voltage driving means and the data voltage driving means, wherein the data electrode driving means has: a latch circuit for holding the sum of coincidence numbers for one horizontal period; a correction signal generating circuit for comparing the held sum of coincidence numbers with a present sum of coincidence numbers and for generating a correction signal when the sums are different; and a voltage selection circuit for shifting the level of a data voltage by the correction signal.

That is, when the sum of the coincidence numbers in the previous horizontal period and the sum of the coincidence numbers in the present horizontal period are different, voltage change in outputs of the data driver occurs and the voltage waveform distortion occurs by the electrostatic capacity of the liquid crystal and the resistance components such as wiring. In order to compensate the distortion amount, means for shifting the voltage level is employed. By adjusting the voltage level to be corrected in accordance with the difference between the sum of the coincidence numbers in the previous horizontal period and the sum of the coincidence numbers in the present horizontal period, great effects can be obtained. In this case, the voltage is corrected by means such as amplitude adjustment, pulse width adjustment, and the like.

DETAILED DESCRIPTION OF THE PREFERRED EMBODIMENTS

A liquid crystal display according to an embodiment of the invention will be described hereinbelow with reference to the drawings. In the following embodiment, a method of selectively driving a plurality of lines is used as a method of driving a liquid crystal display panel and the number (m) of lines to be simultaneously selected is set to 2.

A liquid crystal display according to a first embodiment of the invention will be described with reference to FIGS. 1 and 3 to 9.

Figure 1:
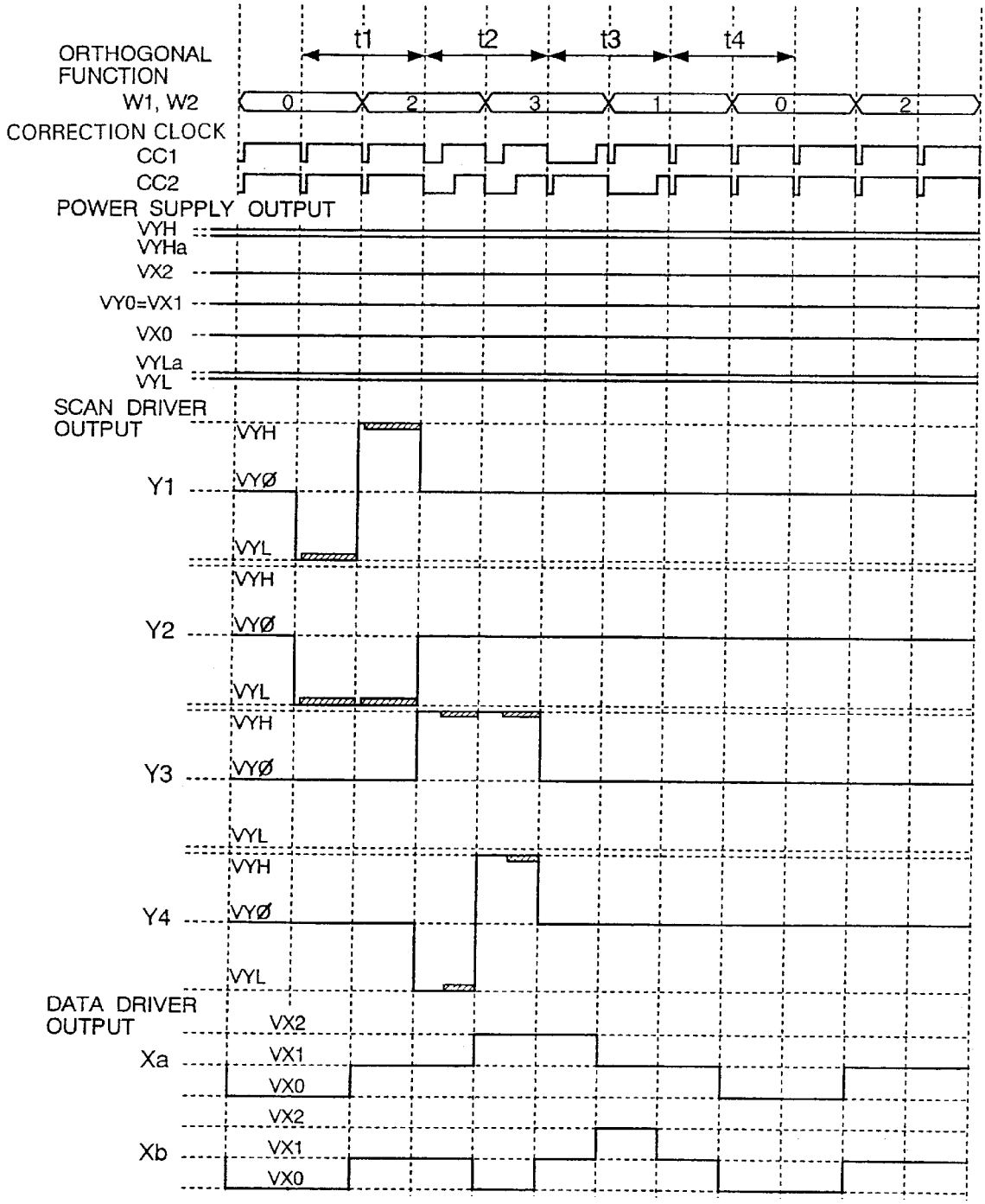
FIG. 1 is a diagram showing power supply outputs, scanning voltages, and data voltages of a liquid crystal display according to a first embodiment of the invention.
Figure 2:
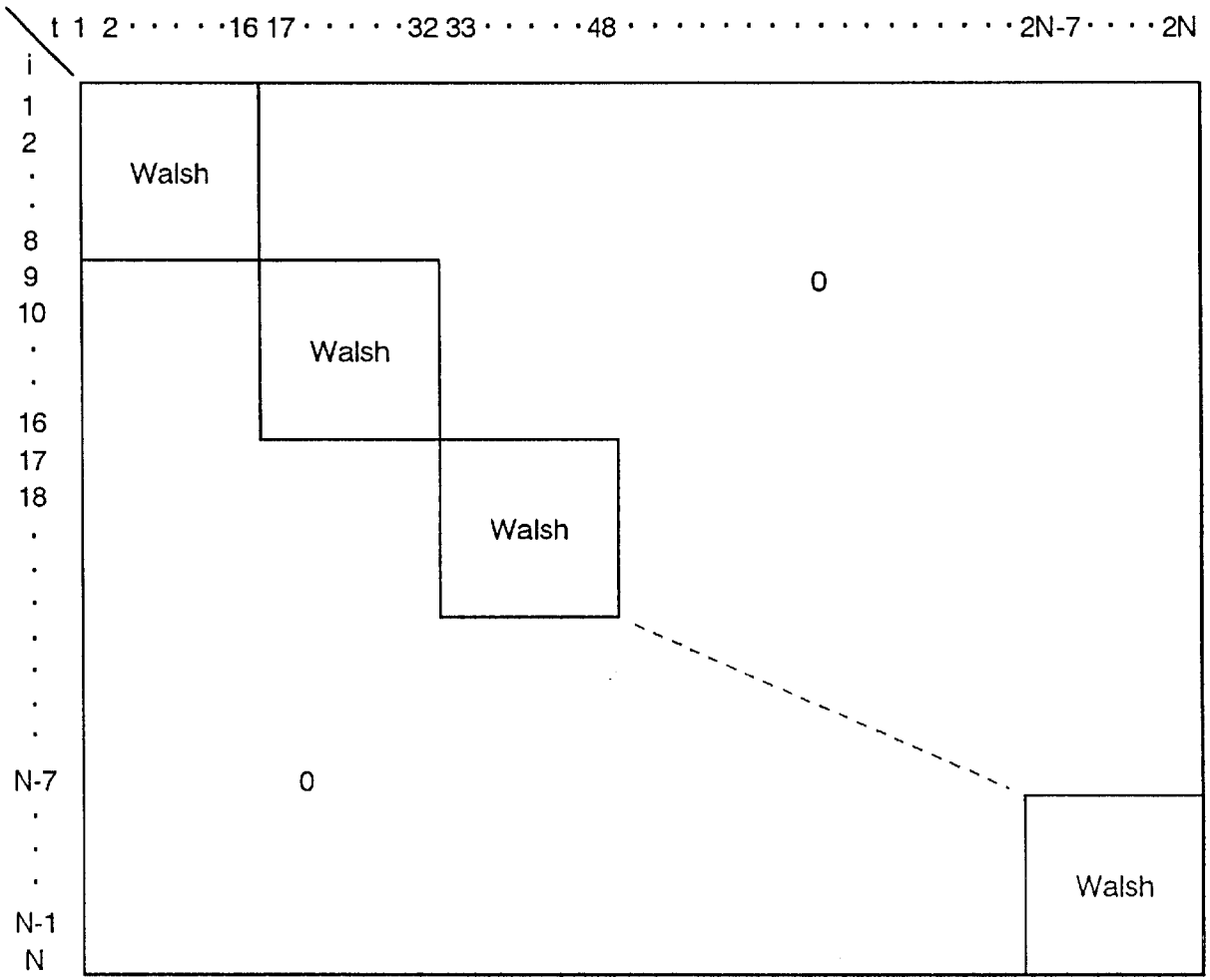
FIG. 2 is a diagram showing the function of a scan voltage of a method of simultaneously selecting and driving a plurality of lines.
Figure 9:
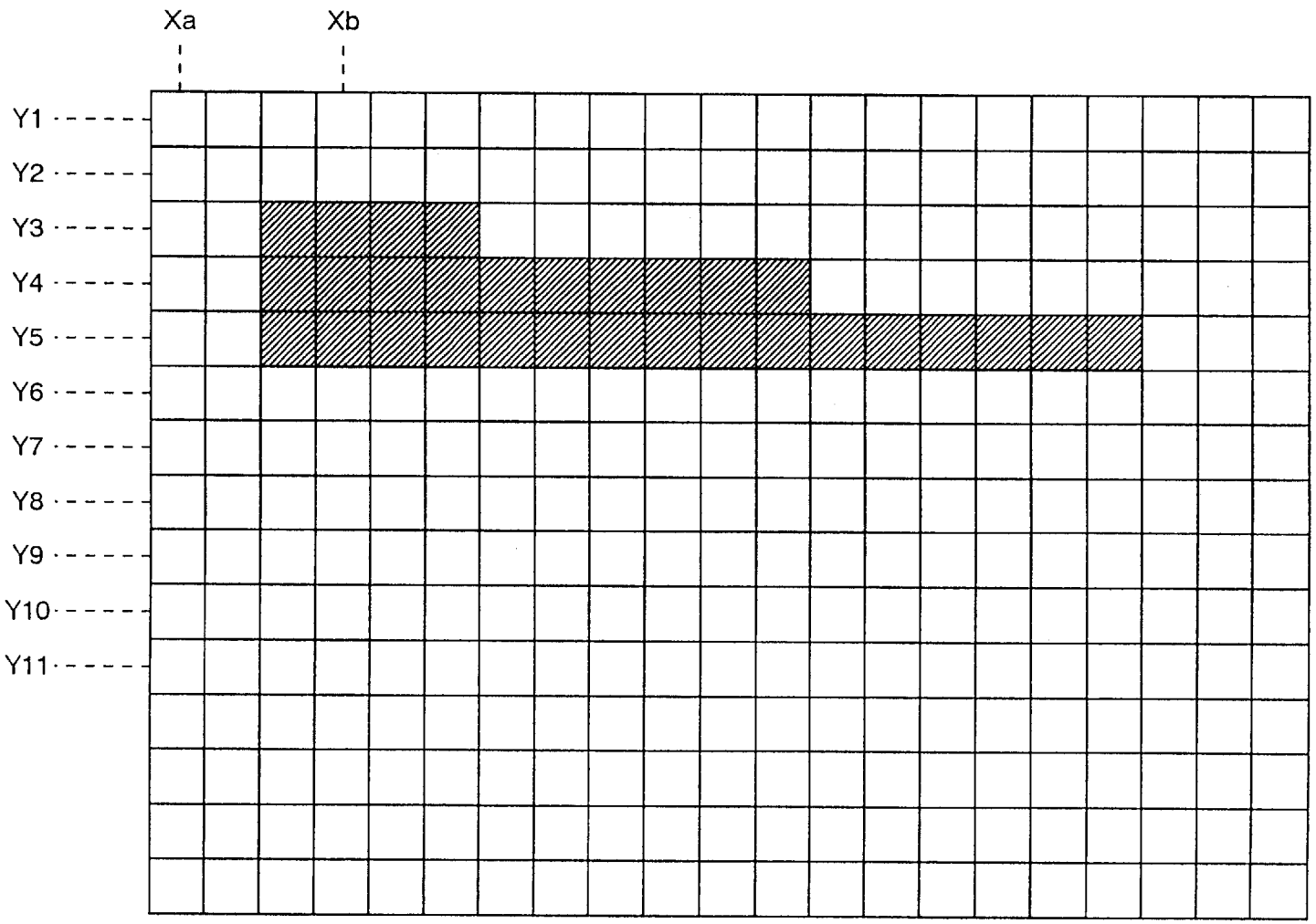
FIG. 9 is a diagram showing an example of a display pattern.

FIG. 1 is a timing chart of signals generated in the liquid crystal display. The timing chart shows a case where bars of on display become longer from the third row to the fifth row on the background of "off" display of the whole plane as shown in FIG. 9. In the liquid crystal display, as shown in FIG. 1, correction clocks CC1 and CC2 each having the pulse width according to the total number of "on" cells in each row of a target to be driven are generated. By correcting an amplitude to reduce an amplitude (an absolute value of a difference voltage from Vy0) of a selective scanning voltage of the scan driver in a period during which the pulse width of the correction clock is at the "H" level, shadowing in the lateral direction due to dielectric constant anisotropy of the liquid crystal cell is reduced.

Figure 3:
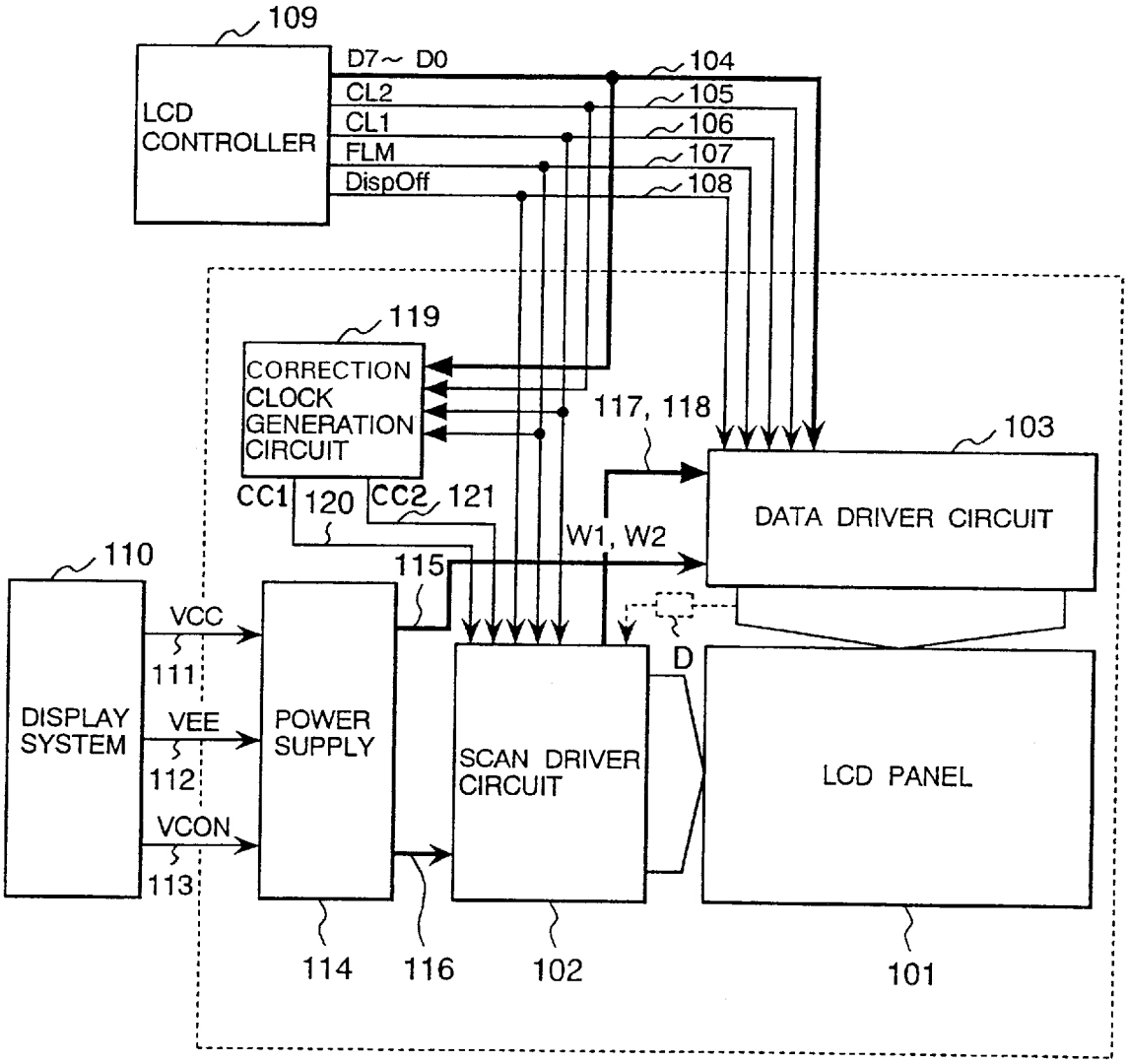
FIG. 3 is a diagram illustrating the construction of the liquid crystal display according to the first embodiment.

FIG. 3 is a block diagram showing the whole construction of the liquid crystal display of the embodiment.

In FIG. 3, the liquid crystal display includes a liquid crystal display panel 101 of a passive matrix display type having the construction of a single display; a scan driver 102 for generating a voltage applied to a scanning electrode of the liquid crystal display panel 101; a data driver 103 for generating a voltage applied to a data electrode; a display system 110; a power supply 114 for generating a voltage applied to the liquid crystal display panel 101 on the basis of a power source voltage supplied from the display system 110; a correction clock generating circuit 119 for generating a correction clock for controlling the amplitude of the application voltage; and a liquid crystal controller 109 for supplying display data, a synchronization signal, and the like.

The scan driver 102 generates and outputs orthogonal function signals W1 (117) and W2 (118). Output signals of the liquid crystal controller 109 include 8-bit parallel display data D7 to D0 (104), a data latch clock CL2 (105) for giving a transfer timing of the display data, a line clock CL1 (106) for giving a pause of one line period of the display data, a head line clock FLM (107) for giving a pause of a period of one frame, and an display "off" control signal DISPOFF (108) for instructing stop of display by "0". Output voltages of the display system 110 include external power source voltages VCC (111) and VEE (112) which are bases of the voltages applied to the liquid crystal display panel 101 and also an adjustment voltage VCON (113) for adjusting the level of the application voltage. The correction clocks generated by the correction clock generating circuit 119 are respectively generated in correspondence to rows which are simultaneously driven. In the embodiment, they are correction clocks CC1 (120) and CC2 (121). The application voltage generated by the scan driver 102 is selected among the group (116) of voltages from the power supply 114. The application voltage outputted by the data driver 103 is selected from the group (115) of voltages from the power supply 114.

The details of the elements of the liquid crystal display will be described hereinbelow. First, the operation of the scan driver 102 will be described with reference to FIG. 4.

The scan driver 102 generates a line selection signal for simultaneously designating two rows as a target to be driven and the 1-bit orthogonal function signals W1 and W2 on the basis of the FLM signal and the CL1 signal. On the basis of the line selection signal, the orthogonal function signals, and the correction clocks CC1 and CC2 from the outside, the voltage applied to the scanning electrode is selected in accordance with the relation shown in FIG. 4. The applying voltage is selected from a group Vy of voltages at 5 levels supplied from the power supply 114 and is applied to the corresponding scanning electrode in the liquid crystal display panel 101.

Figure 4:
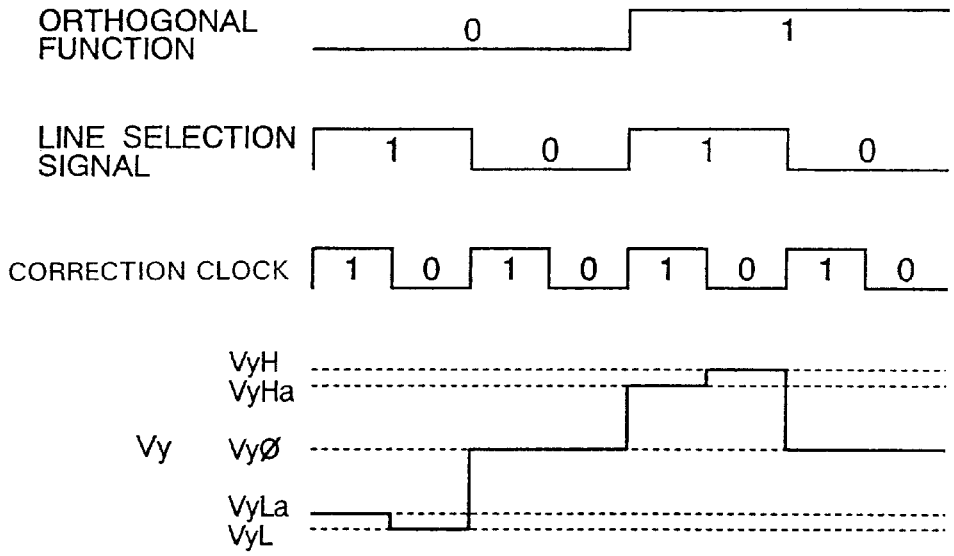
FIG. 4 is a diagram for explaining the operation of a scan driver in FIG. 3.

That is, as shown in FIG. 4, in the row where the orthogonal function signal is "0" and the line selection signal is "1" (scan state), when the correction clock is "1", a VyLa voltage is selected. When the correction clock is "0", a VyL voltage is selected. In the case where the orthogonal function is "1" and the line selection signal is "1", when the correction clock is "1", a VyHa voltage is selected. When the correction clock is "0", a VyH voltage is selected. In the case where the line selection signal is "0" (not scan state), irrespective of the orthogonal function signal and the correction clock, a Vy0 voltage 141 is selected. That is, when the correction clock is "0", the selective scanning voltage has a larger amplitude. When the display "off" control signal DISPOFF signal 108 is "0" (not display state), all of the line selection signals are "0" and all of the applying voltages are the Vy0 voltage.

The operation of the data driver 103 will be described with reference to FIG. 5.

The data driver 103 has a line data latch circuit of two lines for fetching the display data 104 in accordance with the CL2 signal and storing the fetched data for two horizontal periods. The display data of two lines is read out from the line data latch circuit and the read display data is compared with the orthogonal function signals W1 and W2 supplied from the scan driver 102 every column. The voltage applied to the data electrode is selected in accordance with the result of the comparison and is applied to a corresponding data electrode in the liquid crystal display panel 101. The application voltage is selected from a group Vx of voltages at three levels supplied from the power supply 114.

Figure 5:
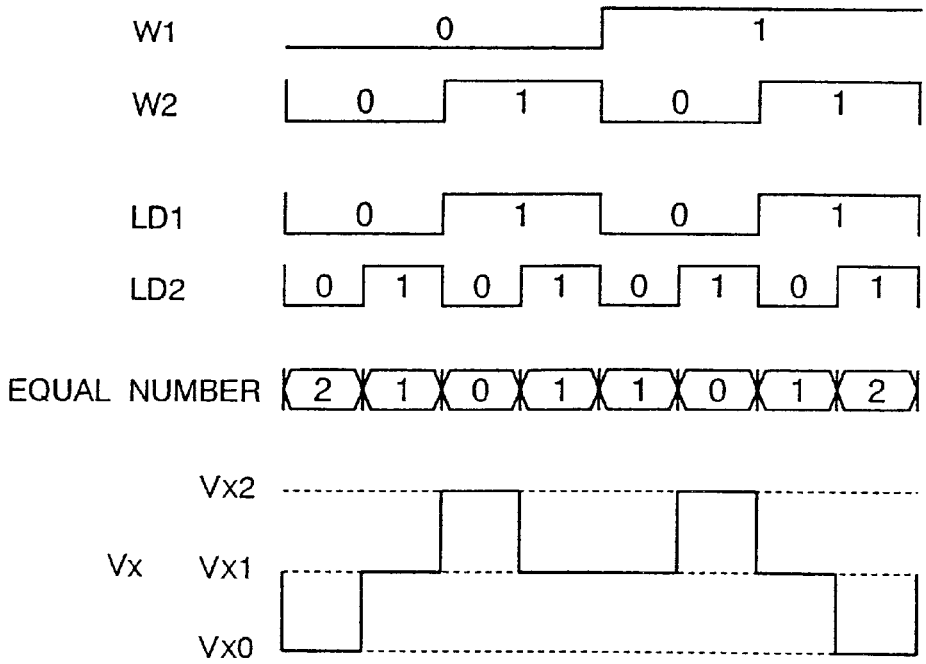
FIG. 5 is a diagram for explaining the operation of a data driver in FIG. 3.

Specifically, as shown in FIG. 5, the values of outputs LD1 and LD2 of the line data latch are compared with the values of the orthogonal function signals W1 and W2 by a coincidence circuit and one of the levels is selected from the application voltages Vx at three levels in accordance with the number of coincidences and is outputted. That is, when the number of coincidences is "0", a Vx2 voltage is selected. When the number of coincidences is "1", a Vx1 voltage is selected. When the number of coincidences is "2", a Vx0 voltage is selected and outputted. When the display "off" control signal DISPOFF signal 108 is "0", the Vx1 voltage is forcedly selected in all of the columns.

An example of the power supply 114 will be described with reference to FIG. 6.

Figure 6:
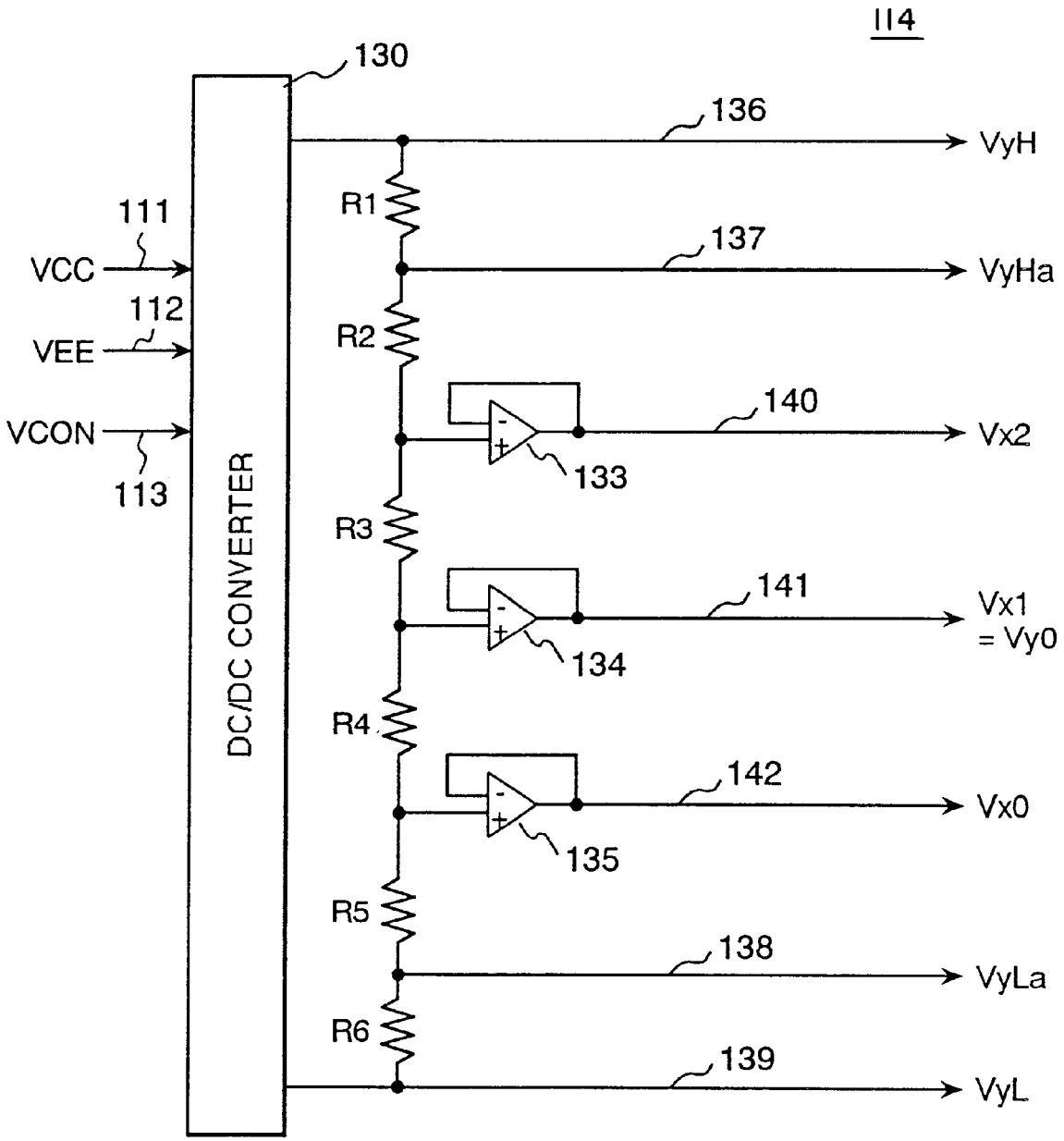
FIG. 6 is a diagram showing the construction of a power supply in FIG. 3.

FIG. 6 is a diagram showing the construction of the power supply 114. As shown in FIG. 6, the power supply 114 has a DC-DC converter 130 driven by a VCC voltage (5V), voltage dividing resistors R1 to R3, and operational amplifiers 133 to 135 and outputs power source voltages at 7 levels. Among them, voltages VyH, VyHa, VyLa, VyL and Vy0 are supplied as a voltage Vy (116) to the scan driver 102. Other voltages Vx0 to Vx2 are supplied as a voltage Vx (115) to the data driver 103.

The power source voltages VyH and VyL of the scan driver are directly generated by the DC-DC converter 130 and the levels are adjusted by the adjusting voltage VCON. The other power source voltages VyHa, VyLa, Vx2, Vx0, and Vy0=Vx1 are generated by dividing the voltage between the power source voltages VyH and VyL with the resistors R1 to R6 which are connected in series. The power source voltages Vx0, Vy0=Vx1, and Vx2 are impedance converted by a voltage follower circuit using the operational amplifiers 133 to 135 and are outputted.

Among the resistors R1 to R6, there are the following relations.

$$R1=R6$$

$$R2=R5$$

$$R3=R4$$

The voltages have the following relations.

$$VyH>VyHa>Vy0>VyLa>VyL$$

$$VyH-Vy0=Vy0-VyL$$

$$VyHa-Vy0=Vy0-VyLa$$

$$Vx2>Vx1>Vx0$$

$$Vx2-Vx1=Vx1-Vx0$$

$$Vy0=Vx1$$

The correction clock generating circuit 119 will be described with reference to FIGS. 7 and 8.

Figure 7:
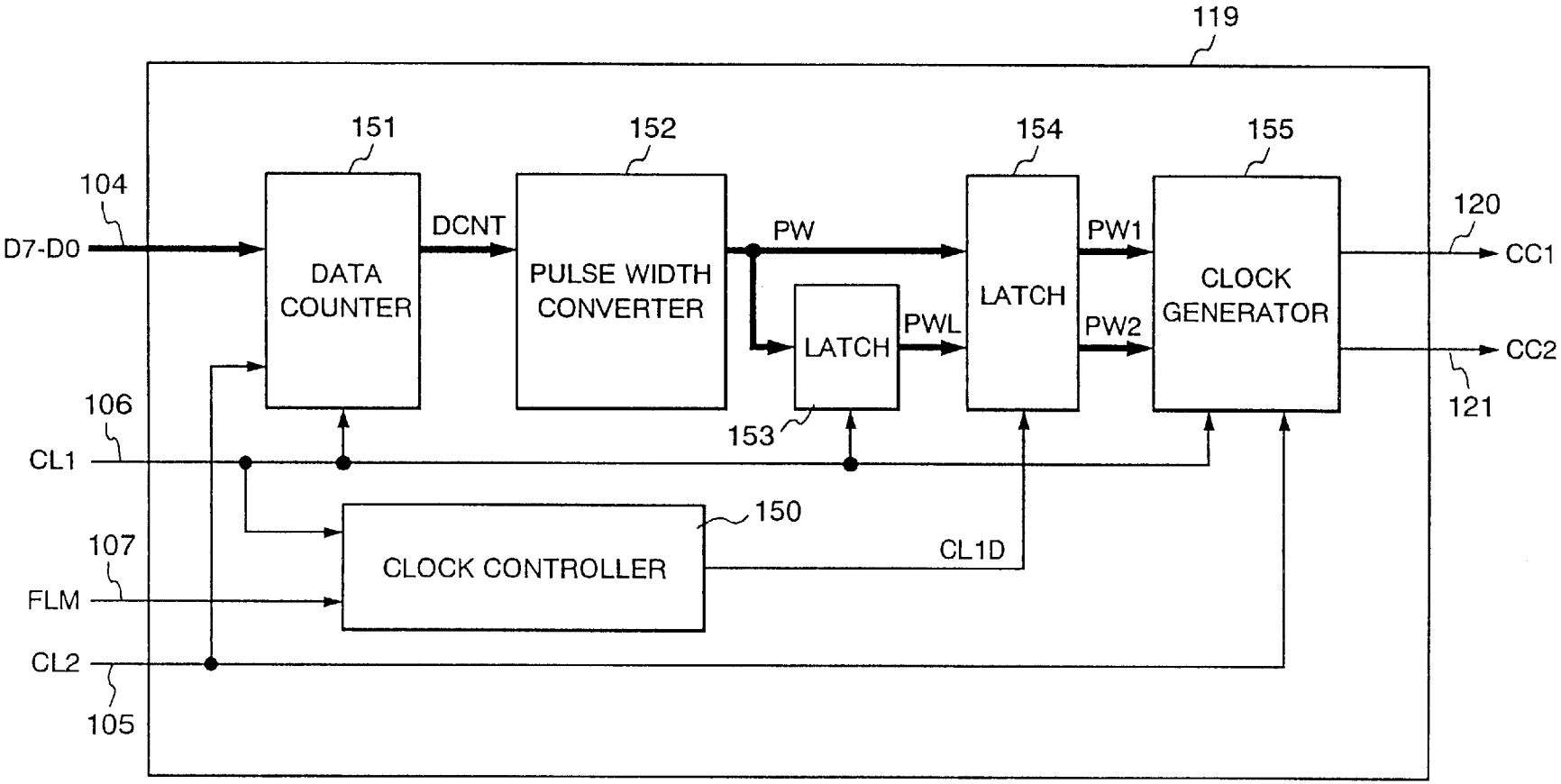
FIG. 7 is a diagram showing the construction of a correction clock generating circuit in FIG. 3.
Figure 8:
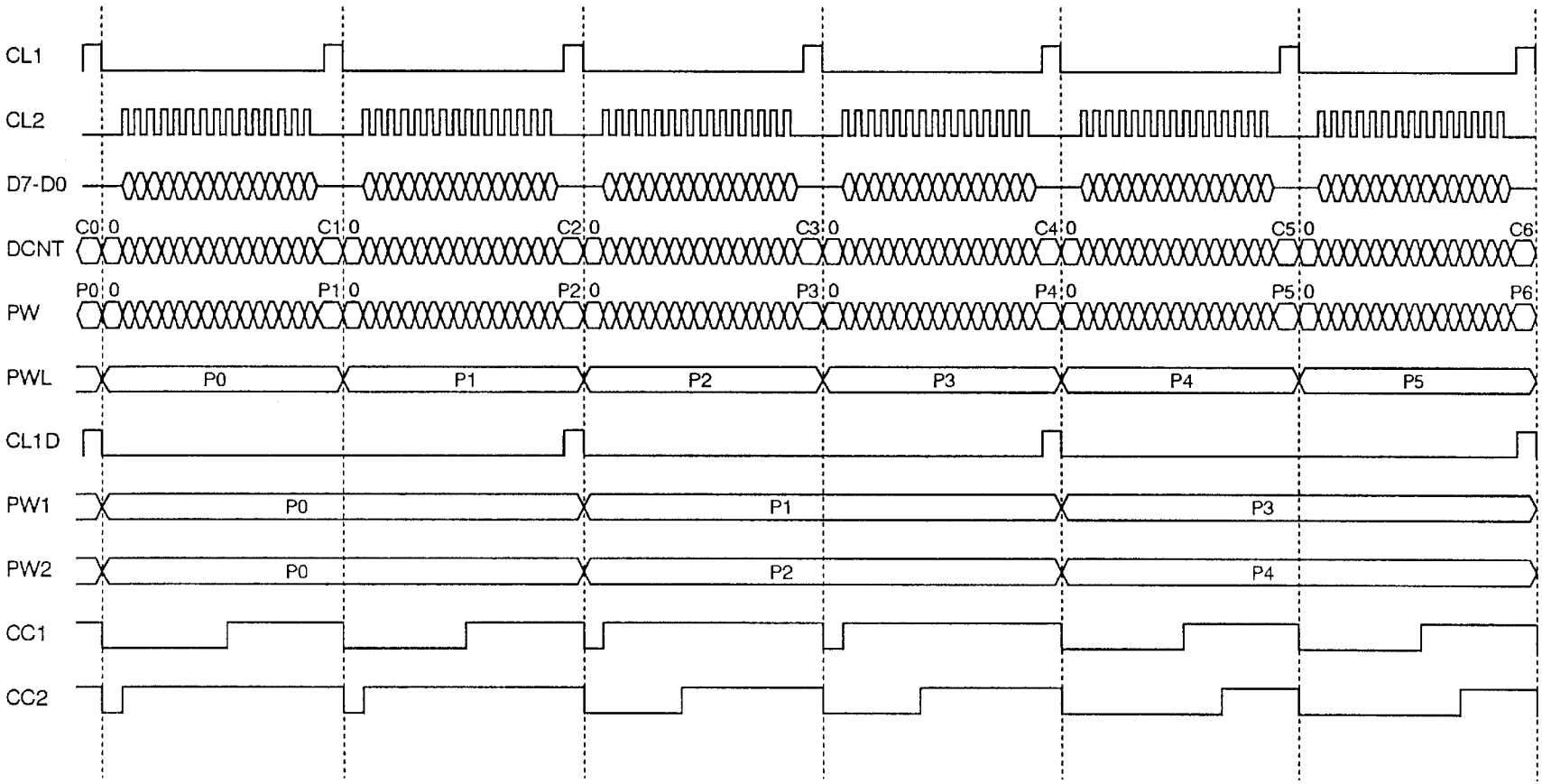
FIG. 8 is a timing chart of the correction clock generating circuit of FIG. 7.

FIG. 7 is a diagram showing the construction of the correction clock generating circuit 119 and FIG. 8 is a timing chart of the circuit 119. As shown in FIG. 7, the correction clock generating circuit 119 comprises a clock control unit 150, a data counter 151, a pulse width converting unit 152, latch circuits 153 and 154, and a clock generating unit 155.

The clock control unit 150 is reset by the FLM signal and generates a signal CL1D which gives a two-clock period of the CL1 signal. The data counter 151 is reset by the CL1 signal and fetches the display data (D7 to D0) in accordance with the CL2 signal. The number of display data of "1" is counted and the result is generated as a DCNT signal. The pulse width converting unit 152 is a decoder circuit which converts the DCNT signal to a PW signal which gives a value predetermined in correspondence with the value. The latch circuits 153 and 154 serve as a parallel latch for arranging and holding the PW signal, which is updated every one clock period of the CL1 signal, of an amount of two clocks of the CL1 signal in parallel. The holding results are outputted as a PW1 signal and a PW2 signal. The clock generating unit 155 outputs the correction clocks CC1 and CC2 on the basis of the PW1 and PW2 signals. Specifically, the clock generating unit 155 is reset by the CL1 signal and sets the correction clocks CC1 and CC2 to "0". When the number of the CL2 signals is counted and the counted value coincides with the value of the signal PW1 or PW2, the clock generating unit 155 changes the correction clock CC1 or CC2 to "1". For example, when the value of the PW1 signal is "10", the correction clock signal is set to "0" by the signal CL1, set to "1" at a time point when the CL2 signals of 10 periods are supplied and keeps the "1" level until the next CL1 signal is supplied.

A specific example of the operation of the liquid crystal display as mentioned above will be described with reference to FIG. 1.

As mentioned above, FIG. 1 shows timings of the internal signals when the bar of "on" is displayed so that the bar becomes longer from the third row to the fifth row on the background of the "off" display as shown in FIG. 9. The hatched portions in the diagram show portions in which the applied voltage is reduced.

In FIG. 1, in a period t1 during which the first and second rows of the scanning electrodes are driven, the number of "on" cells in each of the rows is zero, so that the correction clocks CC1 and CC2 have the long pulse width. The amplitude of the voltage applied to each of the scanning electrodes Y1 and Y2 is reduced to the level of VyHa or VyLa for a long period which is the same as that of the pulse width.

In a period t2 in which the third and fourth rows are driven, since the bar is displayed on both of the rows, the pulse width of each of the correction clocks CC1 and CC2 is shorter than that in the period t1. Since the bar in the fourth row is longer than that in the third row, the pulse width of the correction clock CC2 corresponding to the fourth row is shorter than that of the correction clock CC1 corresponding to the third row. Consequently, also in a period in which an application voltage is reduced to VyHa or VyLa, the scanning electrode Y3 is shorter than the scanning electrodes Y1 and Y2 in the period t1 and the scanning electrode Y4 is further shorter.

As mentioned above, the period in which the amplitude of the application voltage to the scanning electrode at the time of driving is reduced becomes shorter, as waveform rounding becomes larger due to increase in electrostatic capacity when the total number of "on" cells is large. The reduction in the effective value of the voltage (potential difference) applied to the liquid crystal cell is therefore compensated irrespective of the presence or absence and length of the bar display, and the shadowing in the lateral direction is reduced.

A liquid crystal display according to a second embodiment of the invention will be described with reference to FIGS. 10 to 16.

The liquid crystal display of the second embodiment is largely different from that of the first embodiment with respect to a point that the application voltage is corrected by the correction clock generating circuit and the power supply.

Figure 10:
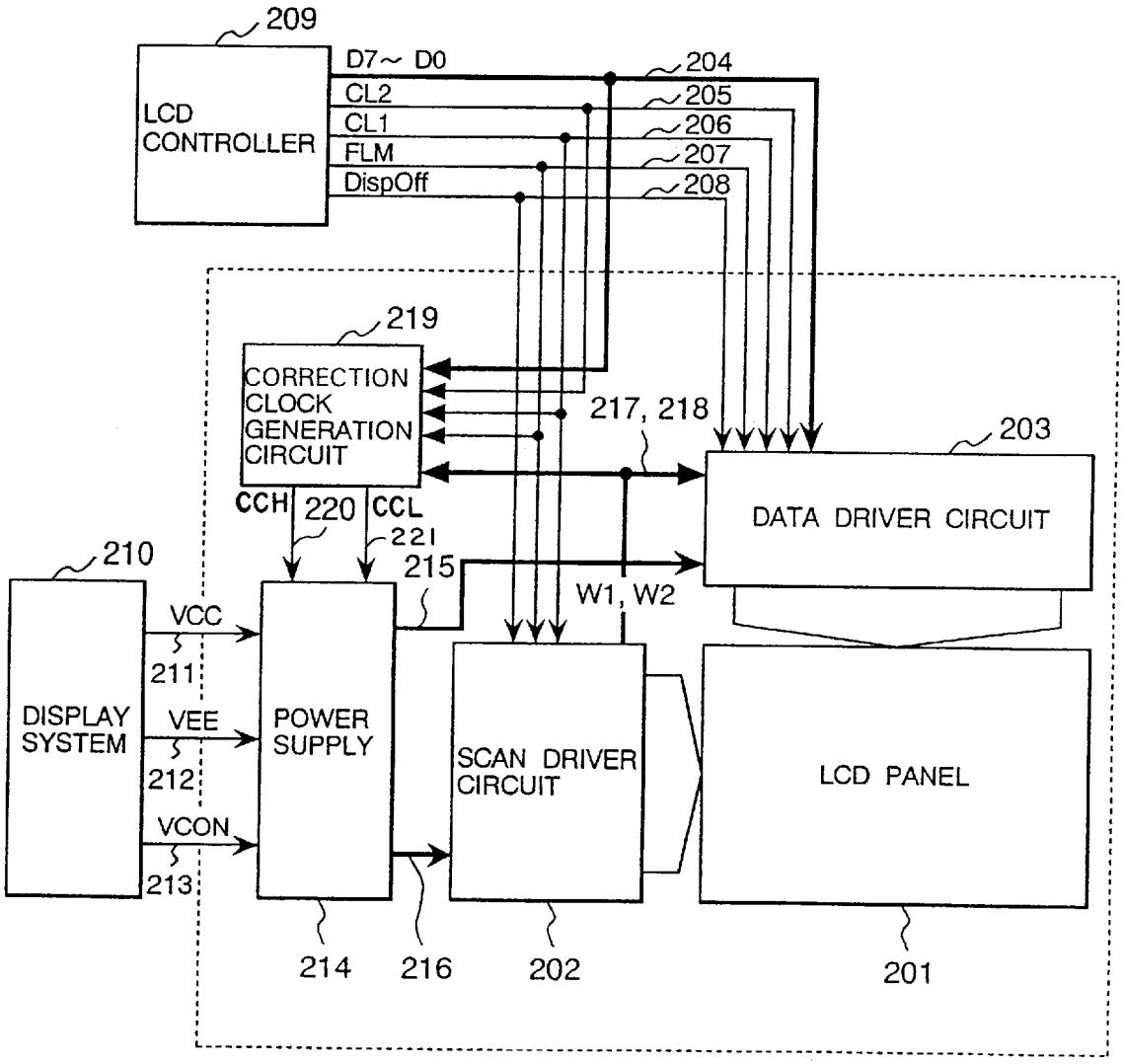
FIG. 10 is a diagram showing the construction of a liquid crystal display according to a second embodiment of the invention.

FIG. 10 is a block diagram showing the construction of the whole liquid crystal display. In FIG. 10, the liquid crystal display has: a liquid crystal display panel 201 of a passive matrix display type having a one-display construction; a scan driver 202 for generating a voltage applied to a scanning electrode in the liquid crystal display panel 201; a data driver 203 for generating a voltage applied to the data electrode; a display system 210; a power supply 214 for generating a voltage applied to the liquid crystal display panel 201 on the basis of the power source voltage supplied from the display system 210; a correction clock generating circuit 219 for generating a correction clock for controlling the amplitude of the application voltage; and a liquid crystal controller 209 for supplying display data, a sync signal, and the like.

The liquid crystal display panel 201, the data driver 203, the liquid crystal controller 209, and the display system 210 are the same as those in the first embodiment and operate similarly. The elements other than the above and control signals will be described hereinbelow.

The scan driver 202 will be described with reference to FIG. 11.

In the scan driver 202 of the embodiment, the application voltage is not corrected. That is, the scan driver 202 generates a line selection signal for simultaneously designating two rows as targets to be driven and one-bit orthogonal function signals W1 and W2 on the basis of the FLM signal and the CL1 signal. A voltage applied to the scanning electrode is selected in accordance with the relation shown in FIG. 11 on the basis of the line selection signal and the orthogonal functions. The application voltage is selected from the group Vy of voltages at three levels supplied from the power supply 214 and is applied to the corresponding scanning electrode in the liquid crystal display panel 201.

Figure 11:
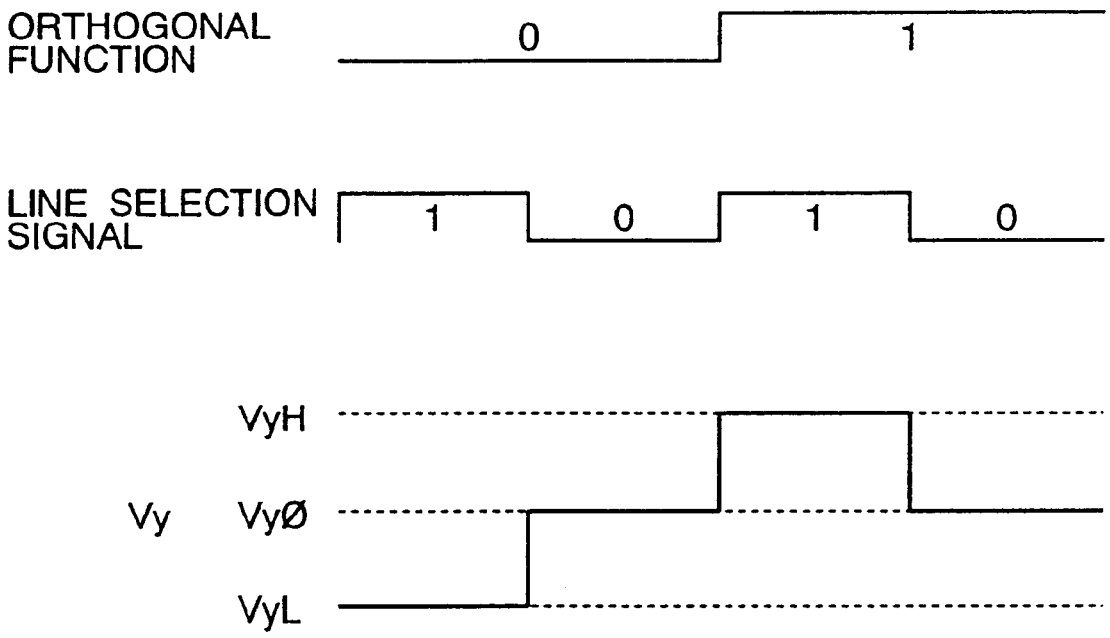
FIG. 11 is a diagram for explaining the operation of a scan driver in FIG. 10.

As shown in FIG. 11, in a row where the orthogonal function is "0"and the line selection signal is "1" (scan state), the voltage VyL is selected. In a row where the orthogonal function is "1" and the line selection signal is "1", the voltage VyH is selected. In the case where the line selection signal is "0" (non-scan state), the voltage Vy0 is selected irrespective of the orthogonal function value. If the display "off" control signal DISPOFF 108 is "0" (non-display), all of the line selection signals are "0" and all of the application voltages to be generated are the voltage Vy0.

The power supply 214 will be described with reference to FIG. 12.

Figure 12:
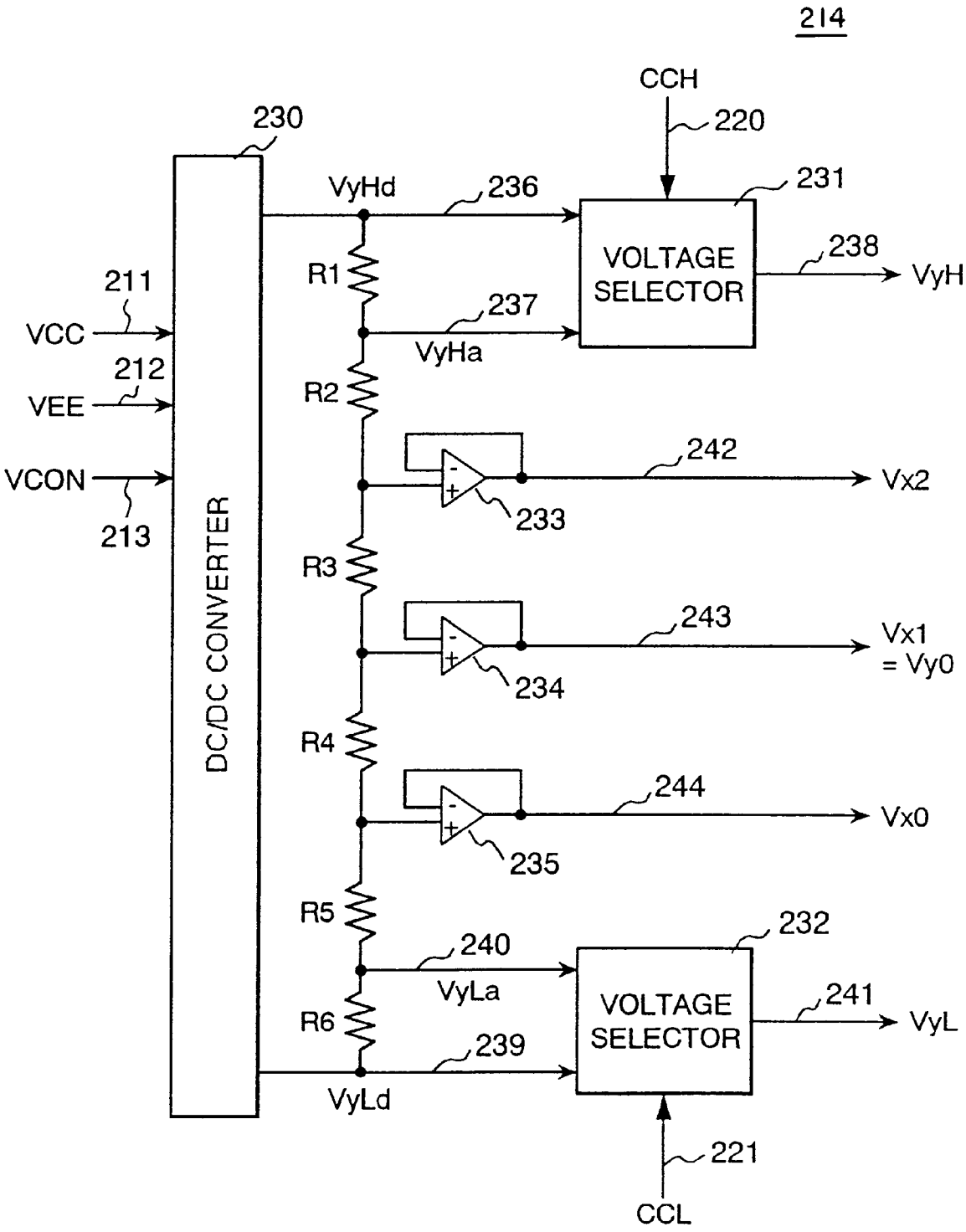
FIG. 12 is a diagram showing the construction of a power supply in FIG. 10.

FIG. 12 is a diagram illustrating the construction of the power supply 214. As shown in FIG. 12, the power supply 214 includes a DC-DC converter 230 driven by a VCC voltage (5V), voltage dividing resistors R1 to R6, operational amplifiers 233 to 235, and voltage selectors 231 and 232 and generates power source voltages at 5 levels. The voltages VyH, VyL, and Vy0 among them are supplied as a power source voltage Vy 216 to the scan driver 202. The other voltages Vx0, Vx1, and Vx2 are supplied as power source voltages Vx 215 to the data driver 203. The voltages Vx1 and Vy0 are the same.

The DC-DC converter 230 generates a power source voltage VyHd as the upper limit value of the application voltage generated by the scan driver and VyLd as the lower limit value. The DC-DC converter 230 adjusts the potential difference between the voltages VyHd and VyLd in accordance with the adjustment voltage VCON.

The voltage dividing resistors R1 to R6 which are connected in series divide the voltage between the voltages VyHd and VyLd and generate power source voltages VyHa, Vx2, Vx1=Vy0, Vx0, and VyLa. The power source voltages Vx0, Vy0=Vx1, and Vx2 are subjected to impedance conversion by a voltage follower circuit using the operational amplifiers 233 to 235 and the resulted voltages are generated.

The voltage selector 231 receives the voltage VyHd and a voltage VyHa at a level slightly lower than that of VyHd, selects either one of them in accordance with a CCH signal, and outputs the selected voltage as a voltage VyH. That is, when the CCH signal is at the "L" level, the voltage VyHd is outputted. When the CCH signal is at the "H" level, the voltage VyHa is outputted. The voltage selector 232 receives the voltage VyLd and a voltage LyLa at the level slightly higher than that of the voltage VyLd, selects either one of them in accordance with a CCL signal, and generates the selected voltage as a voltage VyL. That is, when the CCL signal is at the "L" level, the voltage VyLd is generated. When the CCL signal is at the "H" level, the voltage VyLa is generated.

The resistors R1 to R6 have the following relations.

$$R1=R6$$

$$R2=R5$$

$$R3=R4$$

The voltages have the following relations.

$$VyHd>VyHa>Vy0>VyLa>VyLd$$

$$VyHd=Vy0=Vy0-VyLd$$

$$VyHa-Vy0=Vy0-VyLa$$

$$Vx2>Vx1>Vx0$$

$$Vx2-Vx1=Vx1-Vx0$$

$$Vy0=Vx1$$

The correction clock generating circuit 219 of the invention will be described with reference to FIGS. 13 to 15.

Figure 13:
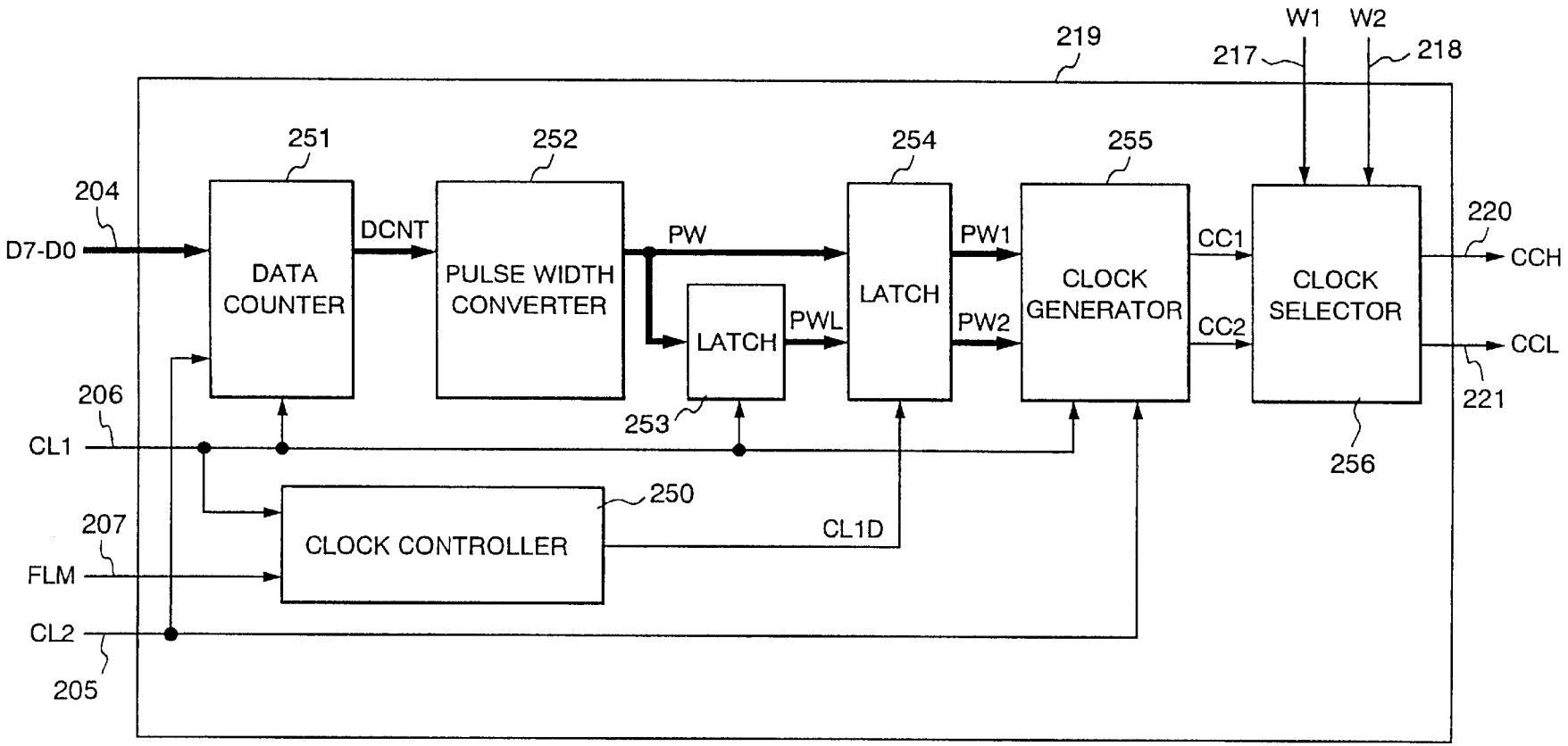
FIG. 13 is a diagram showing the construction of a correction clock generating circuit in FIG. 10.

FIG. 13 shows a block construction of the correction clock generating circuit 219. In FIG. 13, the correction clock generating circuit 219 includes a clock control unit 250, a data counter 251, a pulse width converting unit 252, latch circuits 253 and 254, a clock generating unit 255, and a clock selector 256. The elements other than the clock selector 256 are the same as those in the correction clock generating circuit 119 of the first embodiment and operate similarly.

Figure 14:
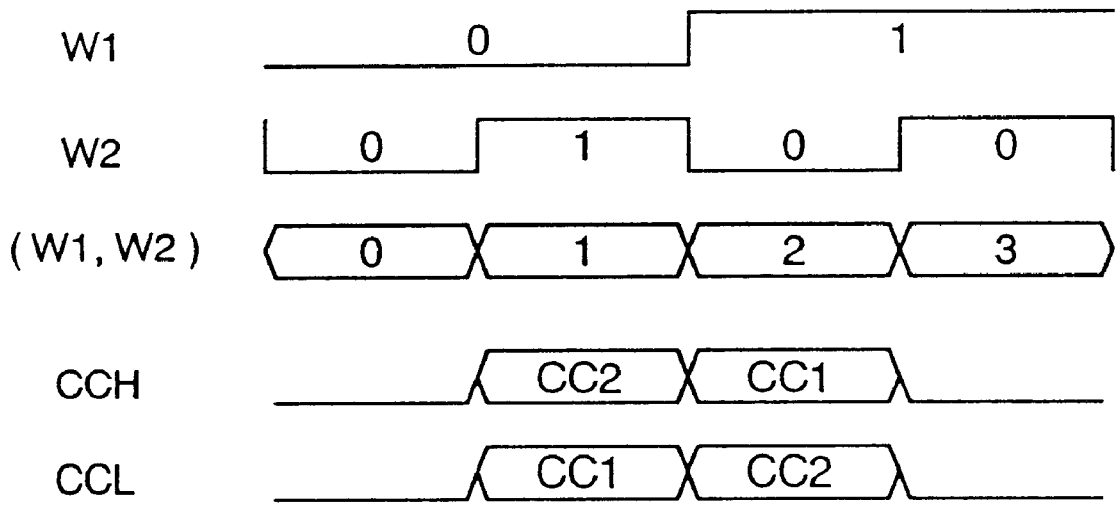
FIG. 14 is a diagram for explaining the operation of a clock selector in FIG. 13.
Figure 15:
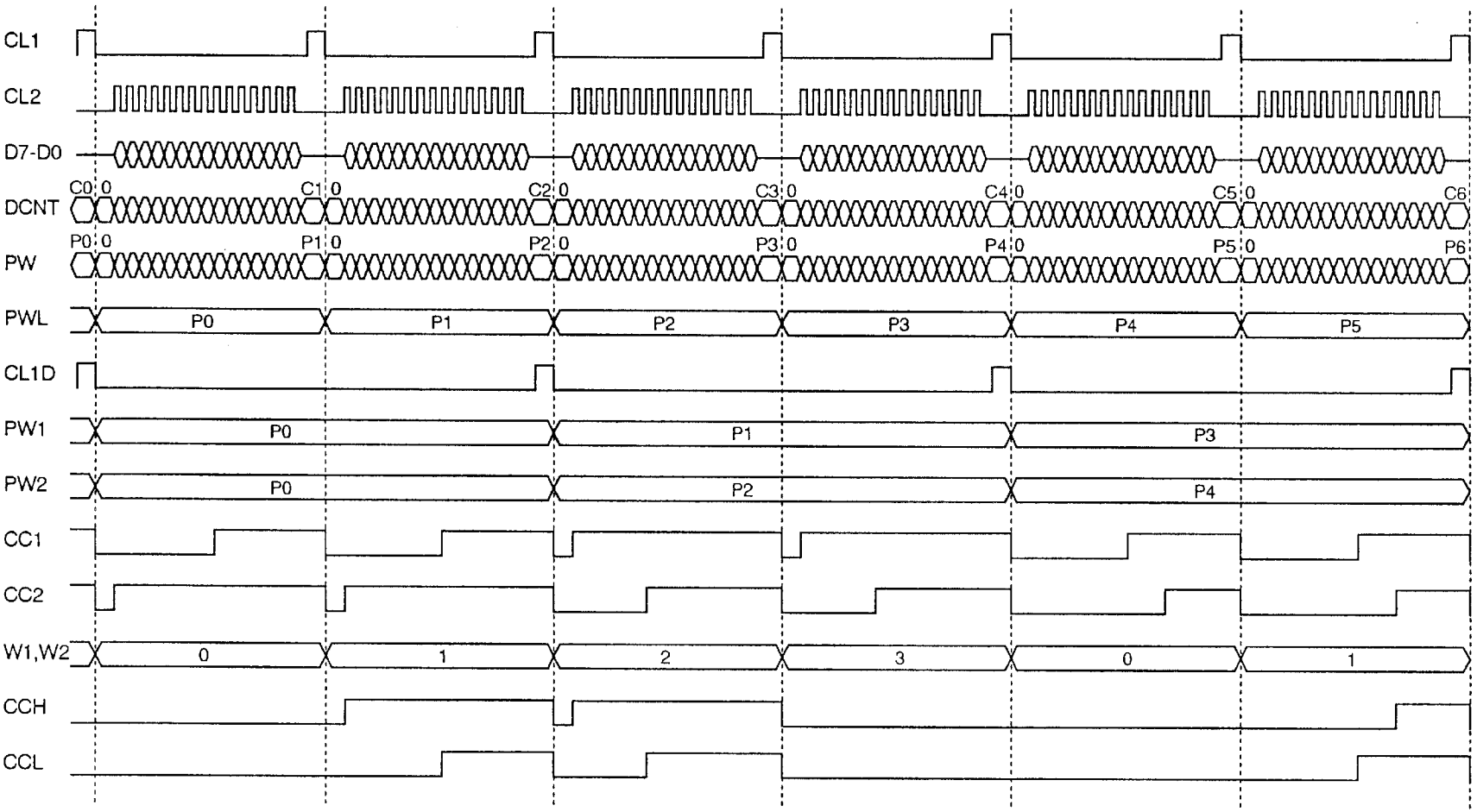
FIG. 15 is a timing chart of a correction clock generating circuit in FIG. 13.

The clock selector 256 generates correction clocks CC1 and CC2 from the clock generating unit 255 as a CCH signal and a CCL signal on the basis of the rule shown in FIG. 14 in correspondence with the orthogonal function signals W1 and W2. That is, when the values (W1, W2) in which the orthogonal function signal W1 shows an upper bit and the orthogonal function signal W2 shows a lower bit are "0" and "3", the signals CCH and CCL are set to the "L" level. When the values of (W1, W2) are "1", the signal CC2 is generated as the signal CCH and the signal CC1 is generated as the signal CCL. When the values of (W1, W2) are "2", the signal CC1 is generated as a signal CCH and the signal CC2 is generated as a signal CCL.

The operation of the correction clock generating circuit 219 will be described with reference to FIG. 15. The operation until the generation of the CC1 signal and the CC2 signal is the same as that in the correction clock generating circuit 119 of the first embodiment. The clock selector 256 selectively outputs the CC1 signal and the CC2 signal as CCL and CCH in accordance with the rule shown in FIG. 14. When the values of the orthogonal functions W1 and W2 coincide, the signal CCL and CCH are set to the "L" level.

A specific example of the operation of the liquid crystal display will be described with reference to FIG. 16.

Figure 16:
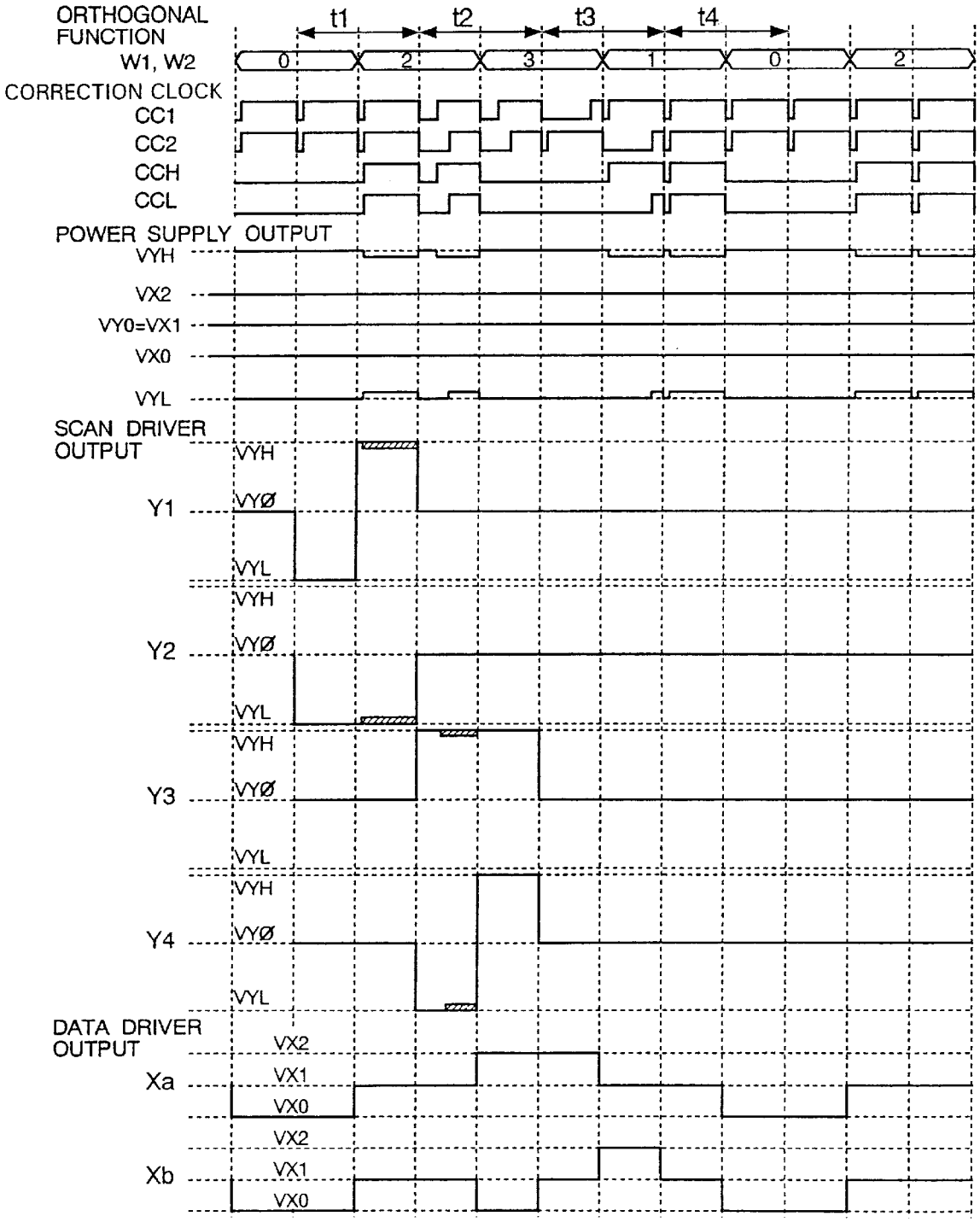
FIG. 16 is a diagram showing power supply outputs, scan voltages, and data voltages of the liquid crystal display of FIG. 10.

FIG. 16 shows a timing chart of internal signals when the bar is displayed by turning on the cells so that the bars become longer from the third row to the fifth row. The hatched portions in the diagram show portions in which the application voltage is reduced.

In FIG. 16, the timing of the correction clocks CC1 and CC2 is similar to that in the first embodiment and has a length according to the number of "on" cells in the corresponding row. In the period t1 in which scanning electrodes in the first and second rows are driven, the number of "on"

cells is "0" in each of the rows. In the later half in which the amplitudes of the voltages applied to the scanning electrodes Y1 and Y2 are inverted around the voltage Vy0 as a center, the amplitudes of the voltages VyH and VyL are reduced to the levels of VyHa and VyLa for a long time based on CCH and CCL. In a period t2 in which the electrodes in the third and fourth rows are driven, the bar is displayed in both of the rows. Consequently, although the amplitudes of the voltages VyH and VyL are reduced in the first half in which the voltages applied to the scanning electrodes Y3 and Y4 are inverted around the voltage Vy0 as a center, the period in which the amplitude is reduced becomes shorter than the case of the period t1. Since the bar display in the four throw is longer than that in the third row, the period in which the amplitude is reduced in the fourth row is shorter than that in the third row.

Since the amplitudes of the voltages VyH and VyL applied to the scanning electrodes are corrected in this way, in a manner similar to the first embodiment, the reduction in the effective value of the voltage applied to the liquid crystal cell is compensated and the shadowing in the lateral direction is reduced irrespective of the presence or absence and length of the bar display.

Although the application voltage in the two horizontal periods (t) in which two rows are selected is corrected in the first embodiment, the application voltage is corrected in only the one horizontal period (t/2) in the two horizontal periods in the second embodiment. By increasing the voltage correction level about twice as high as that in the first embodiment, almost the same effect as the first embodiment can be obtained.

One voltage selector is necessary in the power supply in the first embodiment. In the second embodiment, although two voltage selectors are necessary, the voltage selector at the output stage of the scan driver is simplified and the costs of the whole system can be reduced.

Figure 17:
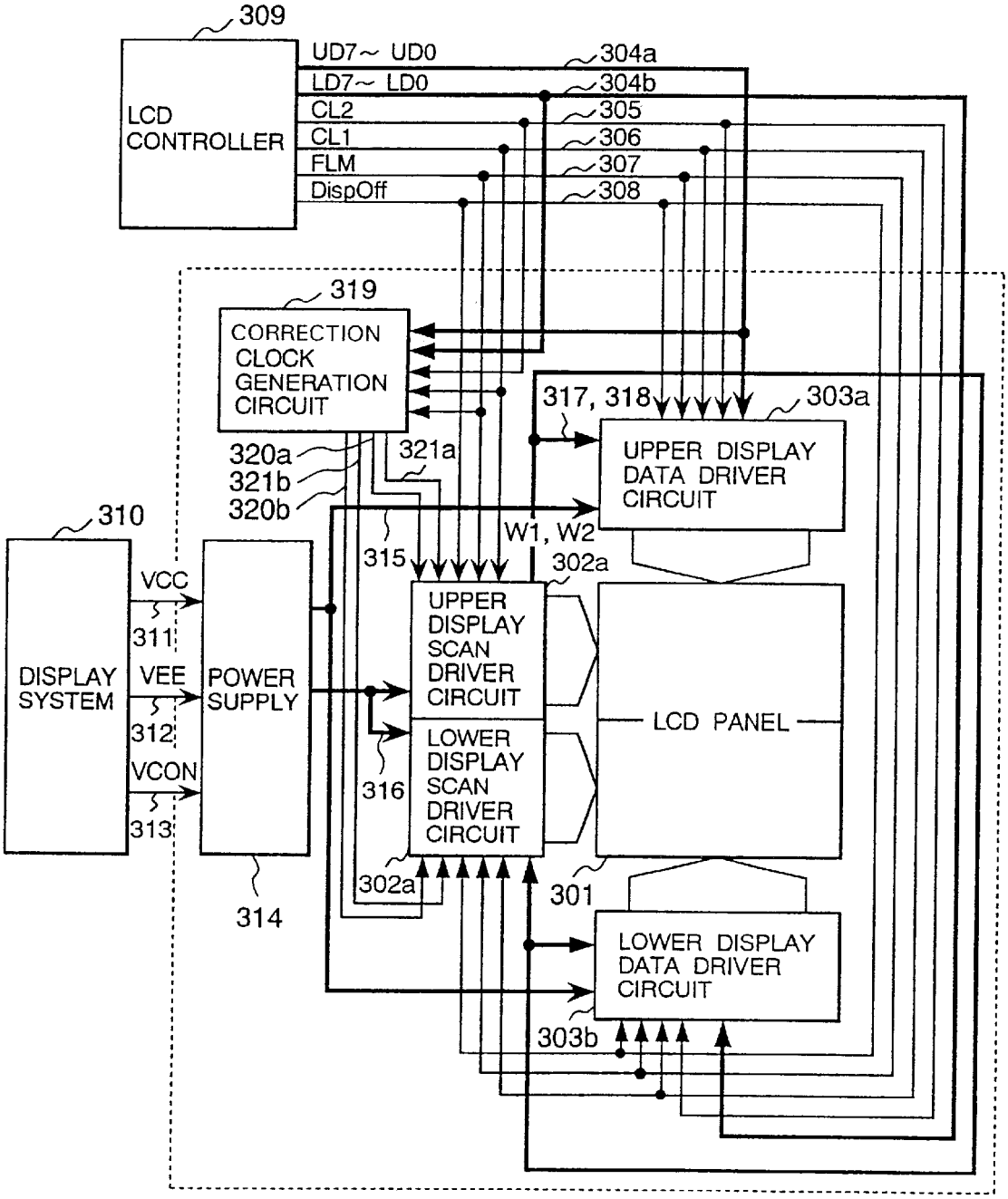
FIG. 17 is a diagram showing the construction of a liquid crystal display according to a third embodiment of the invention.

A third embodiment of the invention will be described with reference to FIG. 17.

In a liquid crystal display of the embodiment, the driving method of the first embodiment is applied to a liquid crystal display panel having the construction of upper and lower two displays. FIG. 17 shows the construction of the whole liquid crystal display of the embodiment. As shown in FIG. 17, scan drivers and data drivers are provided for the upper and lower displays of the liquid crystal display panel, respectively. The scan drivers and the data drivers drive the corresponding displays by operation similar to that in the first embodiment. A liquid crystal controller parallelly generates display data UD7 to UD0 for the upper display and display data LD7 to LD0 for the lower display. A correction clock generating circuit has accordingly the two-system circuit construction and generates the correction clocks CC1 and CC2 to the scan driver for the upper display on the basis of the display data for the upper display and also generates the correction clocks CC1 and CC2 to the scan driver for the lower display on the basis of the display data for the lower display. The generation of the correction clock in the correction clock generating circuit and the control of the amplitude correction of the application voltage in each of the scan drivers are performed by similar operation as that in the first embodiment. By driving the scanning electrodes by the application voltages corrected by the scan drivers, shadowing in the lateral direction is improved in each of the upper and lower displays.

A fourth embodiment of the invention will be described with reference to FIGS. 18 and 19.

In a liquid crystal display of the embodiment, the driving method of the second embodiment is applied to the liquid crystal display panel having the construction of upper and lower displays.

Figure 18:
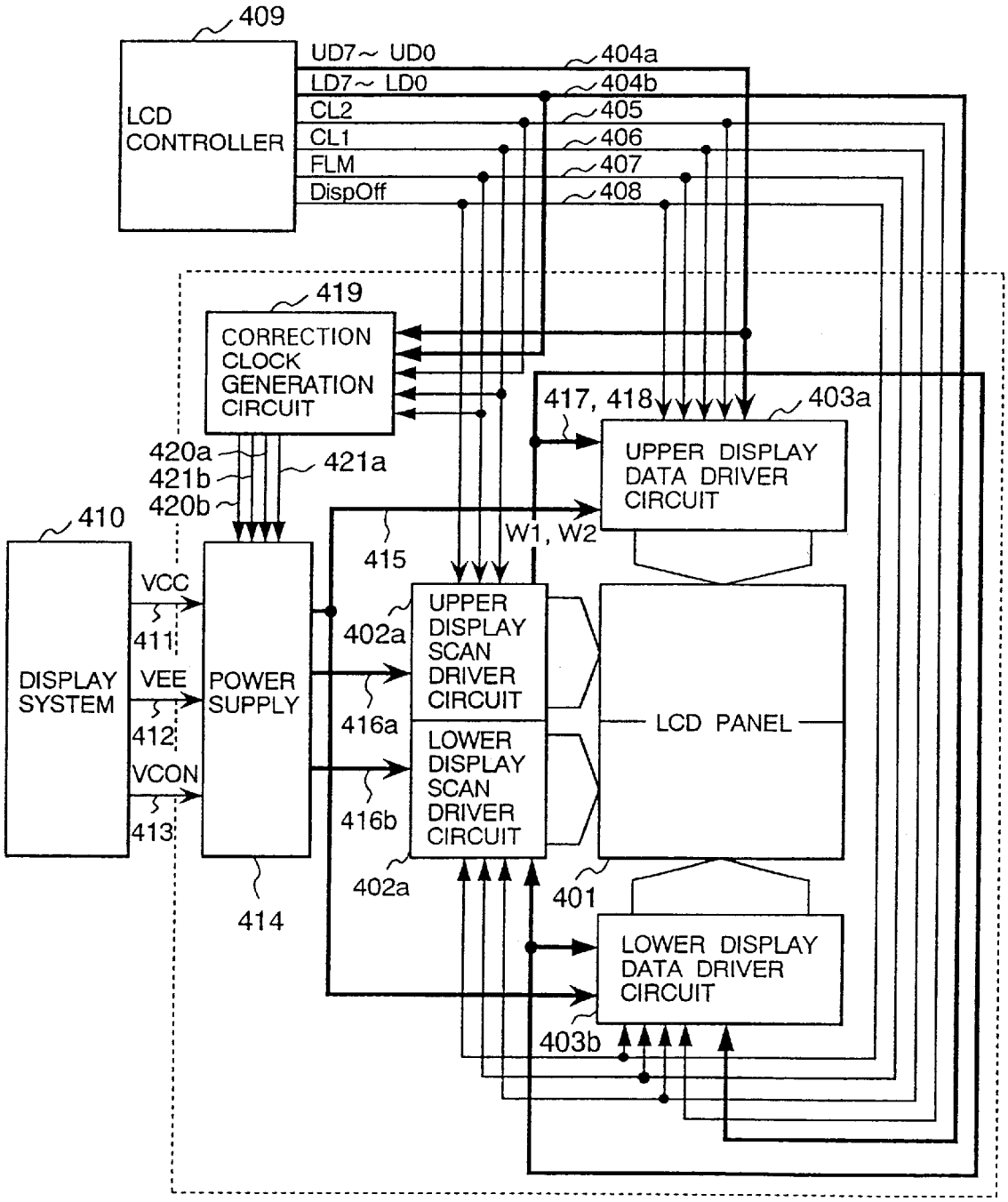
FIG. 18 is a diagram showing the construction of a liquid crystal display according to a fourth embodiment of the invention.

FIG. 18 shows the construction of the whole liquid crystal display of the embodiment. As shown in FIG. 18, in the liquid crystal display, scan drivers and data drivers are provided to the upper and lower displays of a liquid crystal display panel, respectively. The scan drivers and the data drivers drive the corresponding displays in a manner similar to the operation of the second embodiment. A liquid crystal controller parallelly generates display data UD7 to UD0 for the upper display and display data LD7 to LD0 for the lower display, respectively. A correction clock generating circuit has accordingly the two-system circuit construction and generates correction clocks CCHa and CCLa for the upper display on the basis of the display data for the upper display and orthogonal function signals W1 and W2 and generates correction clocks CCHb and CCLb for the lower display on the basis of the display data for the lower display. The correction clocks are generated in the correction clock generating circuit in a manner similar to the operation of the second embodiment.

Figure 19:
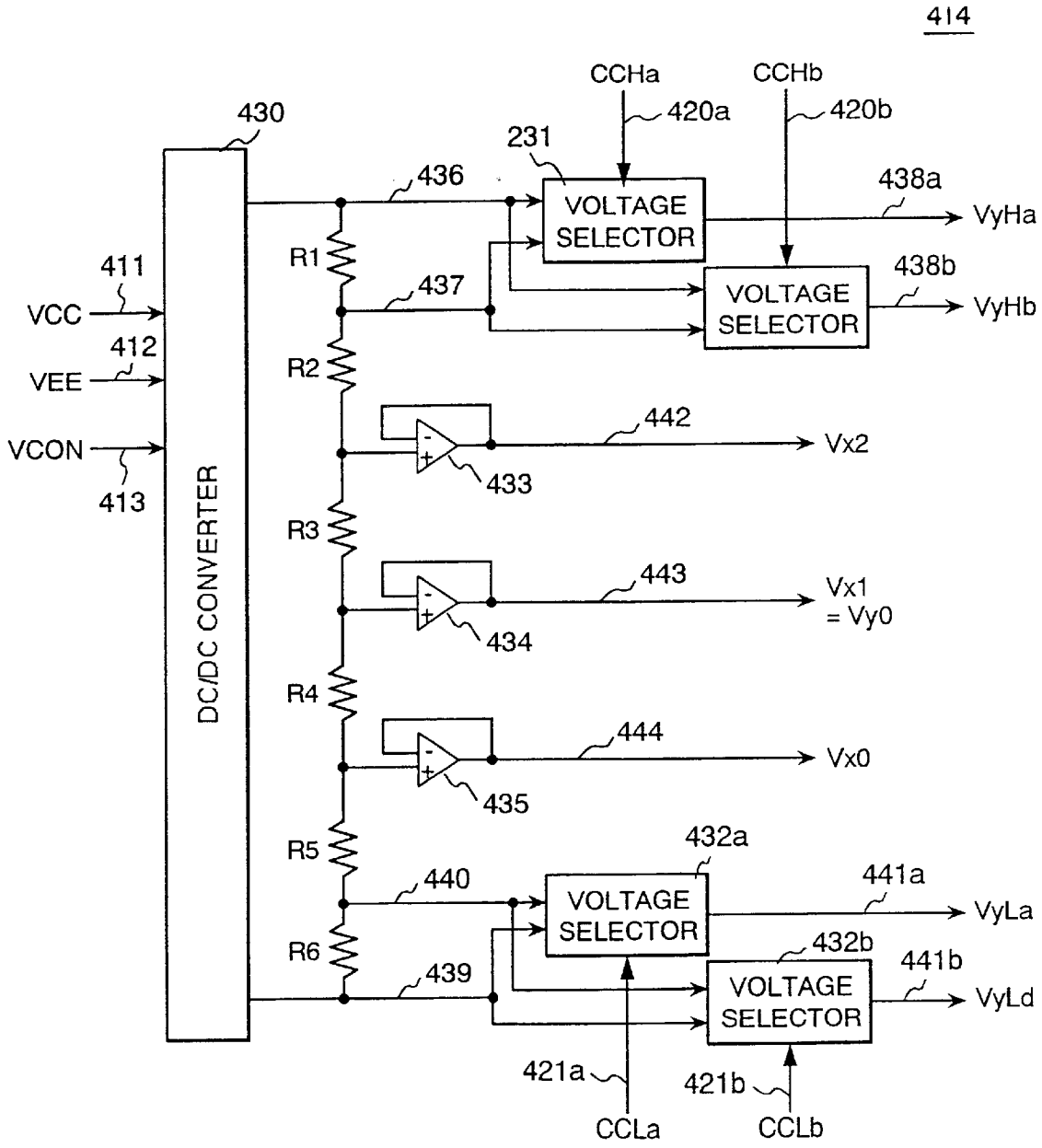
FIG. 19 is a diagram showing the construction of a power supply in FIG. 18.

FIG. 19 shows the construction of a power supply 414 showing FIG. 18. As shown in FIG. 19, the power supply of the embodiment has voltage selectors of two systems for the upper and lower displays. That is, the power supply has two voltage selectors for selectively generating an application voltage VyHa or VyLa in accordance with the correction clock CCHa or CCLa for the upper display and also has two voltage selectors for selectively generating an application voltage VyHb or VyLb in accordance with the correction clock CCHb or CCLb for the lower display. The application voltage whose amplitude is corrected in a manner similar to the second embodiment is generated for each display.

By applying the corrected application voltage to the scanning electrode, the shadowing in the lateral direction is improved in each of the upper and lower displays.

Figure 20:
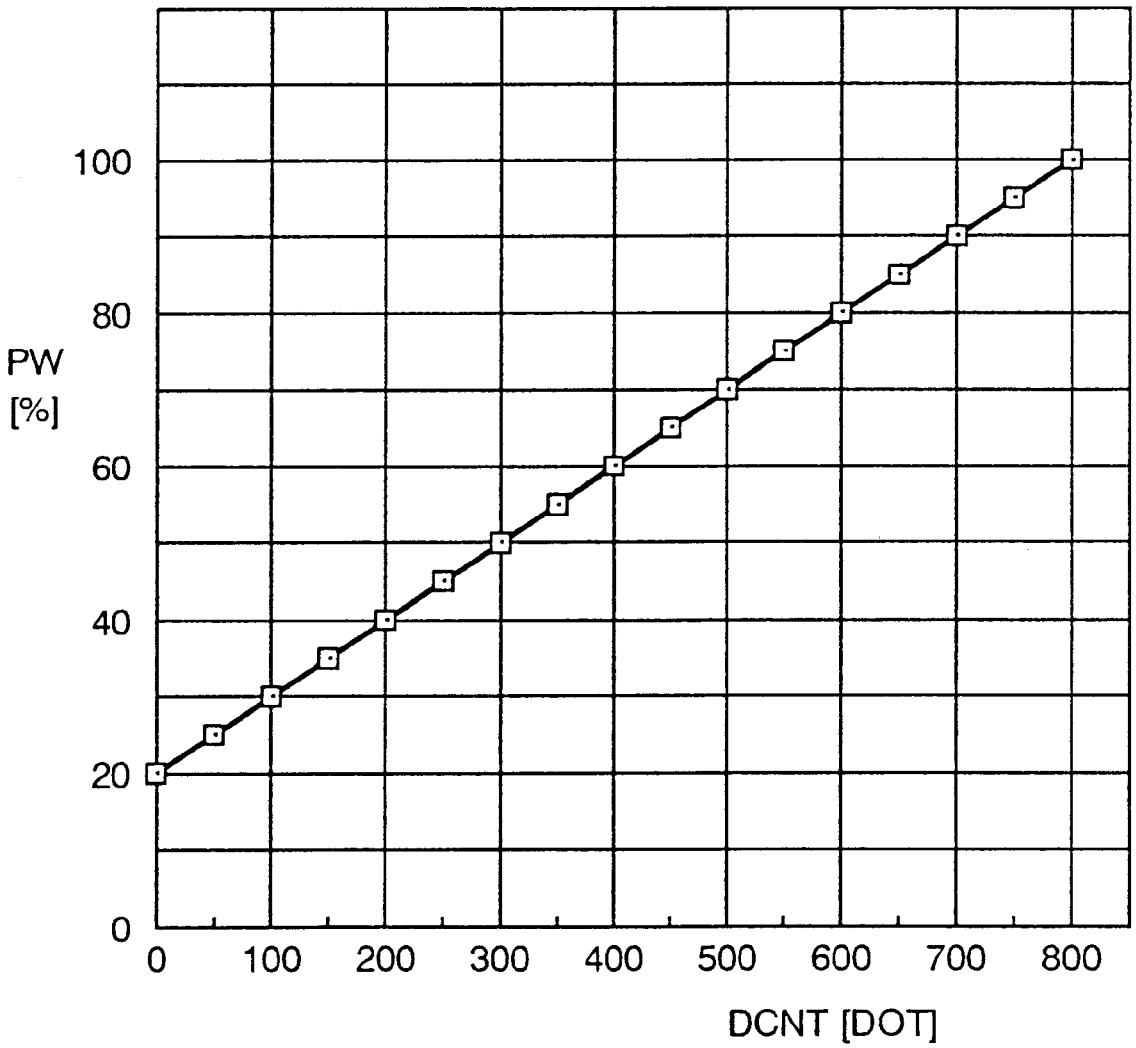
FIG. 20 is a diagram showing an example of the relation between the number of cells which are "on" and the pulse width of a correction clock (ratio of the "L" periods").

In the foregoing embodiments, the length of the pulse width ("H" period) of each of the correction clocks CC1 and CC2 becomes shorter as the number of "on" cells in the corresponding row increases. FIG. 20 shows a specific example of the relation between the ratio (PW) of the "L" period of the pulse width of the correction clock and the number (DCNT) of "on" cells in the corresponding row. In the example of FIG. 20, the total number of pixels per row is 800 dots. It can be said that the ratio of the "L" period of the correction clock and the number of "on" cells have the almost proportional relation. The diagram is just an example. Since the relation differs according to the characteristics of the liquid crystal display panel and the drivers, it is necessary to design the correction clock generating circuit in accordance with the relation.

In the foregoing embodiments, the power supply is formed on a single chip as a single drive IC. Although the function of generating the orthogonal function signals W1 and W2 is arranged in the scan driver in the above embodiments, it can be also realized as an independent circuit. Further, the function may be also combined with the power supply and formed on a chip as a single drive IC.

Although the number of lines simultaneously selected is 2 in the foregoing embodiments, the invention is not limited to the number. Similar effects can be obtained also in the case where the method is applied to a liquid crystal display where the number m of lines is a value other than 2. In this case, the number of voltage levels supplied to the data driver in the power supply is set to (m+1) levels. That is, since the concept of the invention is that the selective scanning voltage is directly corrected, it can be applied to all of methods of driving the liquid crystal display panels of the passive matrix display type which can be mentioned at present.

Although the influence by the dielectric constant anisotropy is estimated by counting the number of "on" cells of the display data in the foregoing embodiments, the invention is not limited to the estimation. The influence by the dielectric constant anisotropy can be also estimated by, for example, change in voltage supplied to the data driver. Transient change in the voltage supplied to the data driver is detected and the correction amount of the selective scanning voltage is adjusted according to the change, thereby enabling the shadowing in the lateral direction to be reduced.

In the liquid crystal displays according to the embodiments of the invention as mentioned above, when display is performed by the method of simultaneously driving a plurality of lines, the influence by the dielectric constant anisotropy is preliminarily estimated and the level of the selective scanning voltage is corrected in accordance with the estimation, thereby enabling the shadowing in the lateral direction to be reduced and display quality to be improved.

The fifth embodiment of the invention will be described hereinbelow with reference to FIGS. 21 to 31 with respect to a case where the number (m) of lines simultaneously selected is set to 2.

Figure 21:
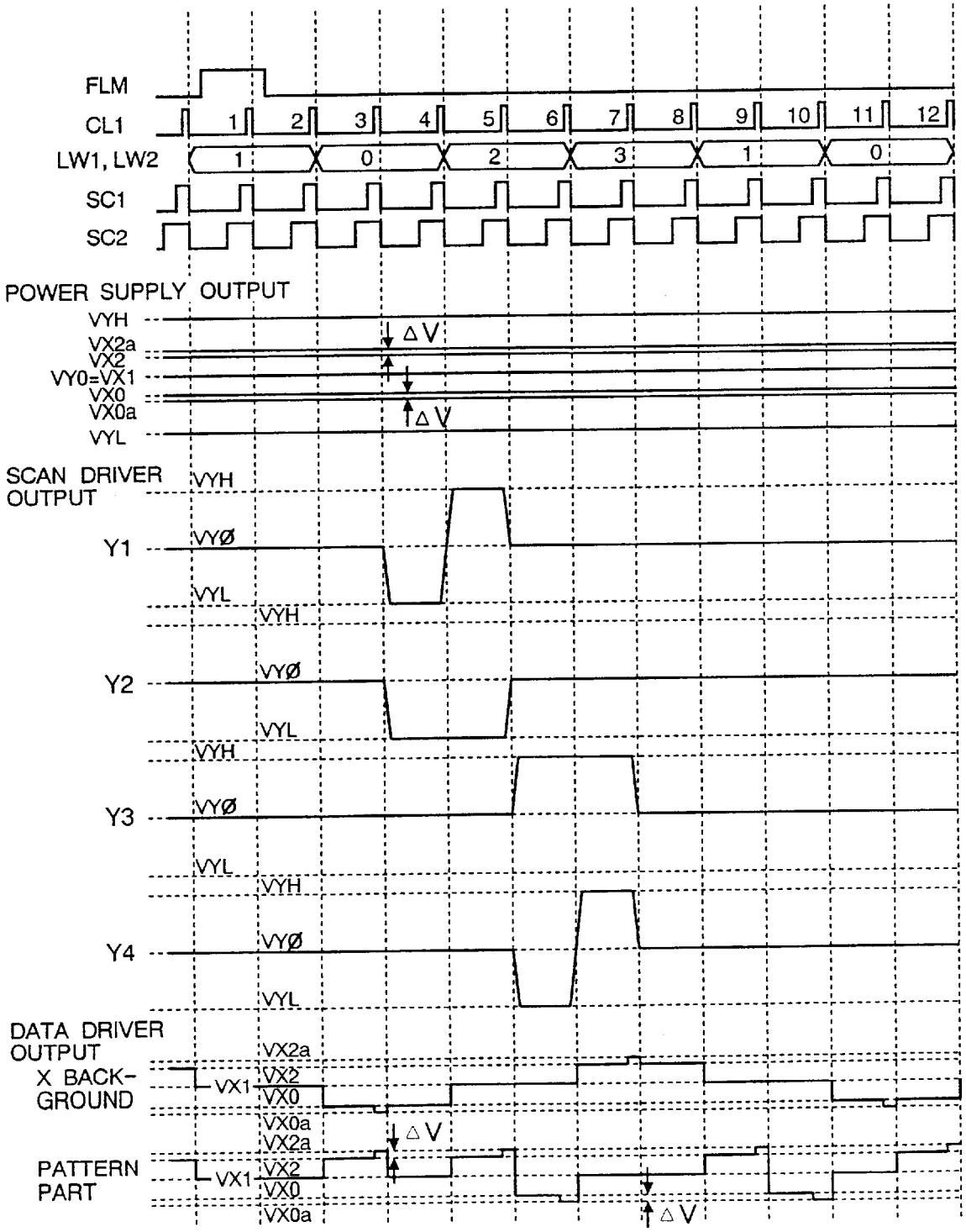
FIG. 21 is a diagram showing power supply outputs, scanning voltages, and data voltages of a liquid crystal display according to a first embodiment of the invention.

FIG. 21 is a timing chart showing outputs from a power supply and voltages applied to a liquid crystal display panel of the fifth embodiment of the invention.

As shown in FIG. 21, with respect to continuous two horizontal periods, when the voltage level changes in the former and latter horizontal periods, the voltage level is shifted in the latter horizontal period in accordance with the changed voltage level. That is, with respect to continuous second and third horizontal periods, since an output of the data driver described as "X background" changes from a Vx1 level in the second horizontal period to a Vx0 level in the third horizontal period, the output changes from the Vx0 level to a Vx0 level synchronously with SC1 during the third horizontal period. Further, since an output of the data driver described as "pattern part" changes from the Vx1 level in the second horizontal period to a Vx2 level in the third horizontal period, the output changes from the Vx2 level to a Vx2a level synchronously with SC1 during the third horizontal period. Since the output of the data driver described as "pattern part" changes from the Vx2 level in the fifth horizontal period to the Vx0 level in the sixth horizontal period, the output changes from the Vx0 level to the Vx0a level synchronously with SC2 during the sixth horizontal period. When the output of the data driver in the previous horizontal period and the present output of the data driver change differently, voltage waveform distortion occurs due to the electrostatic capacity of the liquid crystal and resistance of components such as wiring. Consequently, means for shifting the voltage level is provided in order to compensate for the distortion. The effective value of the voltage to be corrected in accordance with the voltage level which changes is changed (in the embodiment, control is performed with the pulse width). An example of the liquid crystal display for realizing the driving method shown in FIG. 21 is shown in FIGS. 22 to 31 and will be described hereinbelow.

Figure 22:
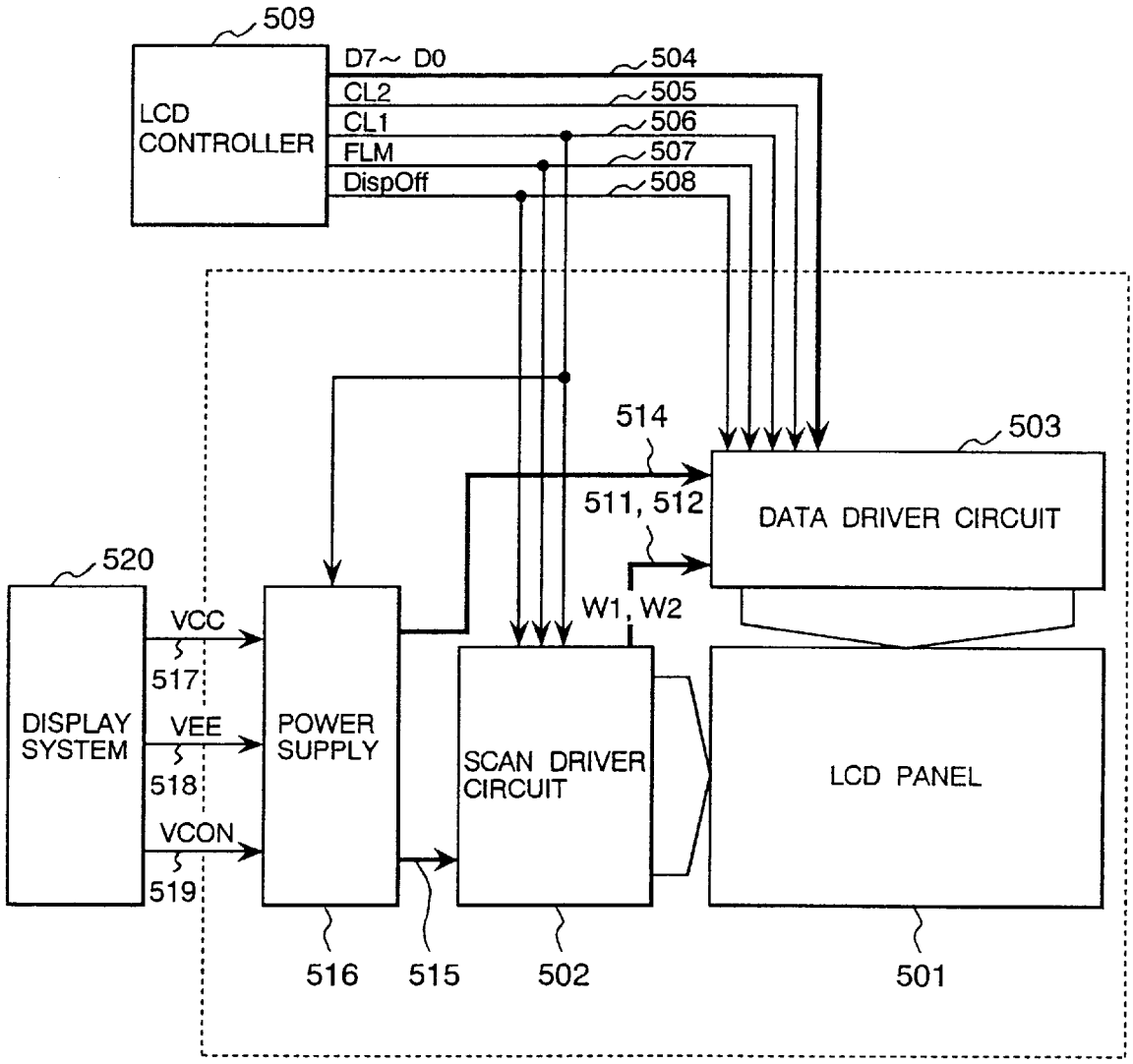
FIG. 22 is a diagram showing the construction of the liquid crystal display according to the first embodiment of the invention.

FIG. 22 is a block diagram showing the construction of the liquid crystal display according to the embodiment of the invention.

In FIG. 22, reference numeral 501 denotes a liquid crystal display panel. It is assumed in the embodiment that the liquid crystal display panel 501 has (i) dots in the vertical direction and (j) dots in the lateral direction. Reference numeral 502 denotes a scanning driver of the invention; 503 a data driver of the invention; 504 8- bit parallel display data D7 to D0; 505 a data latch clock CL2 synchronized with the display data 504; and 506 a line clock CL1. Data of one line is sent during a period of the line clock 506. Reference numeral 507 indicates a head line clock FLM. One period of the head line clock 507 is a period of one frame. Reference numeral 508 denotes a display "off" control signal DISPOFF. When the signal is "0", the display is stopped. The display data and synchronization signals 504 to 508 are supplied from a liquid crystal controller 509. Reference numerals 514 and 515 are power source voltages for driving the liquid crystal display panel and 516 indicates a power supply for generating the liquid crystal driving voltages 514 and 515. Reference numerals 517 and 518 are external power source voltages VCC and VEE (GND) as the base of the group of liquid crystal driving voltages 514 and 515. Reference numeral 519 denotes a voltage VCON for regulating the voltage level of the liquid crystal driving voltage group, which is supplied from a display system 520. 511 and 512 show orthogonal functions generated by the scanning driver 502.

The operation of each of the blocks of the liquid crystal display shown in FIG. 22 will be described hereinbelow with reference to FIGS. 23 to 31.

Figure 23:
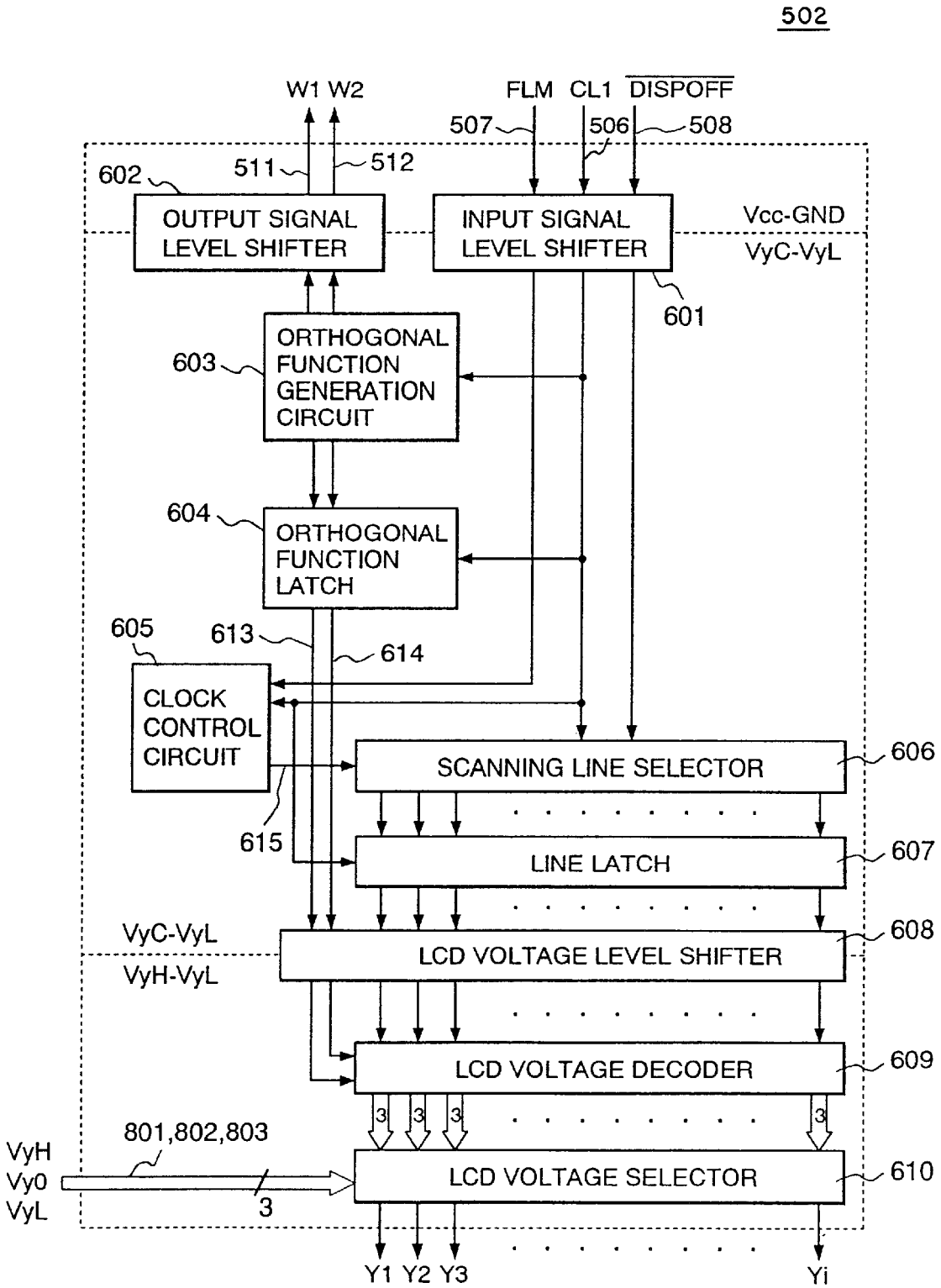
FIG. 23 is a block diagram of a scanning driver in FIG. 22.
Figure 24:
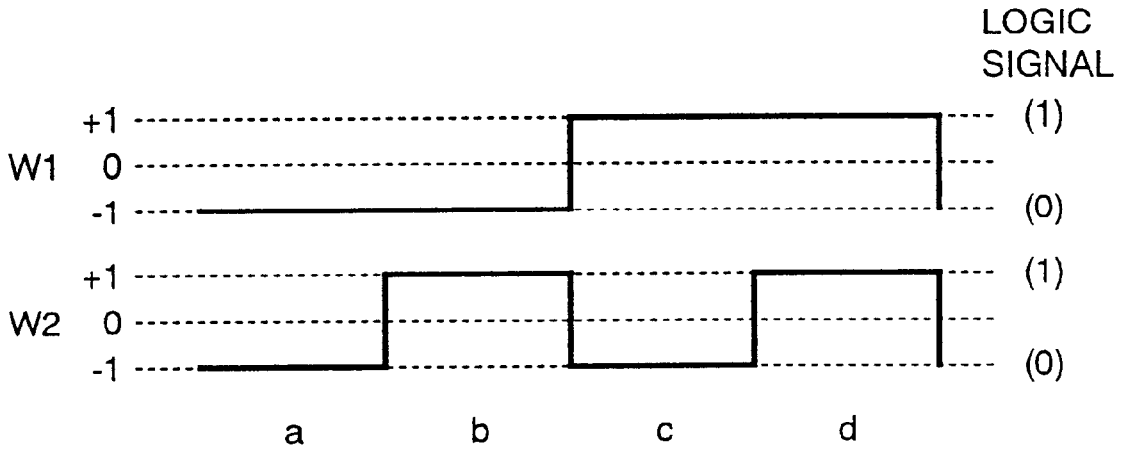
FIG. 24 is a diagram for explaining the operation of a scanning function generating circuit built in the scanning driver of FIG. 23.
Figure 25:
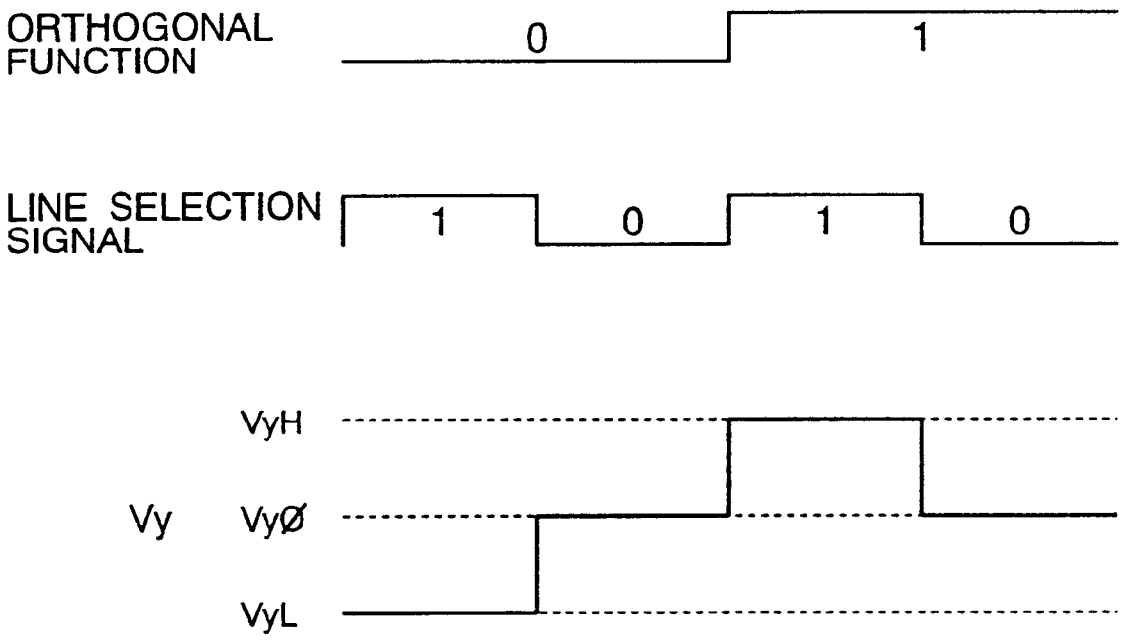
FIG. 25 is a diagram for explaining output operation of the scanning driver of FIG. 23.
Figure 26:
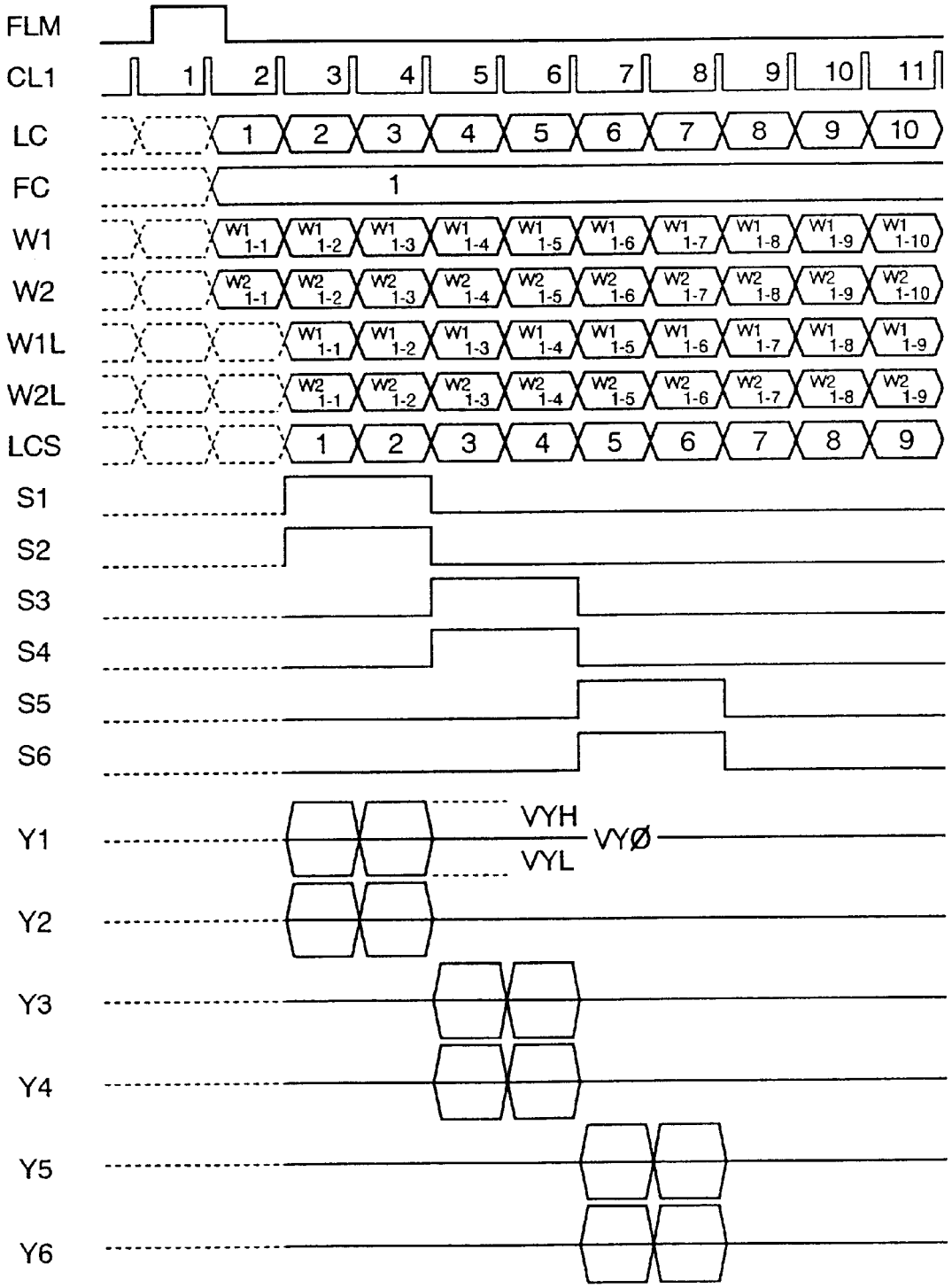
FIG. 26 is a diagram for explaining output operation timing of the scanning driver of FIG. 23.

An example of the scanning driver 502 of the invention will be described by using FIGS. 23 to 26. FIG. 23 is a diagram showing the construction of the scanning driver 502 of the invention. FIG. 24 is a diagram for explaining the orthogonal functions generated in the scanning driver 502. FIG. 25 is a diagram for explaining the operation of the scanning driver 502. FIG. 26 is a diagram showing operating timing of the scanning driver 502.

As shown in FIG. 23, the scanning driver 502 of the invention includes; an input signal level shifter 601, an output signal level shifter 602, an orthogonal function generating circuit 603, an orthogonal function latch circuit 604, a clock control circuit 605, a scan line selector 606, a line latch 607, a liquid crystal voltage level shifter 608, a liquid crystal voltage decoder 609, a liquid crystal voltage selector 610, and liquid crystal voltage output terminals Y1 to Yi. Reference numerals 511 and 512 are 2-bit orthogonal function signals W1 and W2.

The input signal level shifter 601 is a circuit for shifting the level between VCC and GND of a group of input signals to the level between VyC and VyL of a voltage for driving an internal logic circuit. The output signal level shifter 602 is a circuit for shifting the group of signals at the level between VyC and VyL generated by the internal logic circuit to the group of signals at the level between VCC and GND. The internal logic circuit after the input signal level shifter 601 operates at the level between VyC and VyL.

The orthogonal function generating circuit 603 is a part for generating the orthogonal functions shown in FIG. 24 and generates the W1 signal 511 and the W2 signal 512 on the basis of a count value FC of the head line signal FLM 507 and a count value LC of the line clock CL1 signal 506.

The orthogonal function latch 604 latches the orthogonal function W1 signal 511 and the W2 signal 512 generated by the orthogonal function generating circuit 603 by the line clock CL1 signal 506 and outputs a function W1L signal 613 and a W2L signal 614 after latch.

The clock control circuit 605 delays the FLM signal 507 by a period of two lines and transfers a scan reference data FLM2 signal 615. The scan line selector 606 is constructed by shift circuits of the number corresponding to the number of liquid crystal voltage output terminals. The scan line selector 606 shifts the FLM2 signal 615 from the clock control circuit 605 in accordance with the line clock CL1 signal 506 and outputs line selection signals S1 to Si. When the display "off" control signal DISPOFF 508 is "0", the shifting operation of the circuit is stopped and the circuit is reset. The line latch 607 is a circuit which latches the line selection signal from the scan line selector by the CL1 signal 506.

The liquid crystal voltage level shifter 608 is a circuit for increasing a signal at the internal logic power source voltage level (voltage level between VyC and VyL) to the voltage between a high voltage VyH for driving the liquid crystal and VyL. The circuit operates at the high voltage VyH level and the VyL level. The liquid crystal voltage decoder 609 and the liquid crystal voltage selector 610 select and output a voltage from scanning voltages for driving liquid crystal at 3 levels in accordance with the combination of the line selection signal and the orthogonal function. For example, when the orthogonal function is "0" as shown in FIG. 25, if the line selection signal is in the "scan (1)" state, a VyL voltage 803 is selected. If the line selection signal is in a "not scanning (0)" state, a Vy0 voltage 802 is selected. When the orthogonal function is "1", if the line selection signal is in a "scan (1)" state, a VyH voltage 801 is selected. If the line selection signal is in a "not scanning" state, the Vy0 voltage 802 is selected. When the display "off" control signal DISPOFF 508 is "0", all of line selection signals enter a "not selecting (0)" state, the Vy0 voltage 802 is generated.

The operation timing of the scanning driver 502 having the above construction is shown in FIG. 26 and will be described.

In the clock control circuit 605, the FLM2 signal 615 obtained by delaying the FLM signal by two scanning periods by the CL1 signal is generated. The orthogonal function generating circuit 603 generates the orthogonal function signals W1 and W2 shown in FIG. 24 in accordance with the count value (FC) of the FLM signal 507 and the count value (LC) of the CL1 signal 506 which is reset by the FLM signal 507. The scanning line selector 606 is reset by the FLM2 signal 615, decodes the count value (LCS) of the CL1 signal, and generates the line selection signals S1 to Si. That is, when the LCS is 1 and 2, only S1 and S2 are set to "1". When the LCS is 3 and 4, only S3 and S4 are set to "1". In this manner, the scanning line selector 606 operates. The liquid crystal voltage decoder 609 and the liquid crystal voltage selector 610 select one of the scanning voltages VyL, Vy0, and VyH for driving the liquid crystal at three levels in accordance with the combination of the line selection signals S1 to Si latched by CL1 in the line latch circuit 608 and the orthogonal functions WL1 and WL2 from the orthogonal function latch 604.

Figure 27:
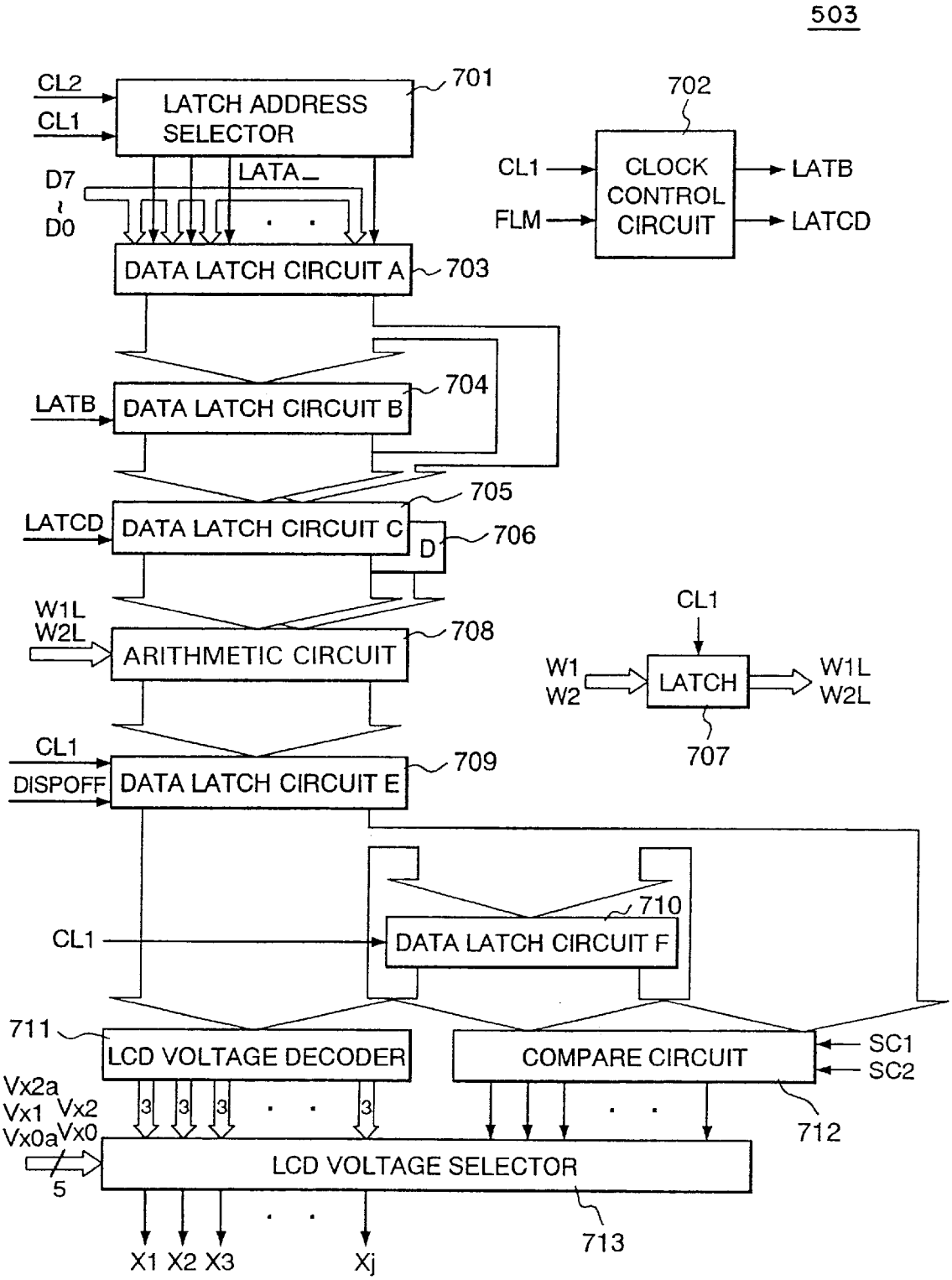
FIG. 27 is a block diagram of a data driver in FIG. 22.
Figure 28:
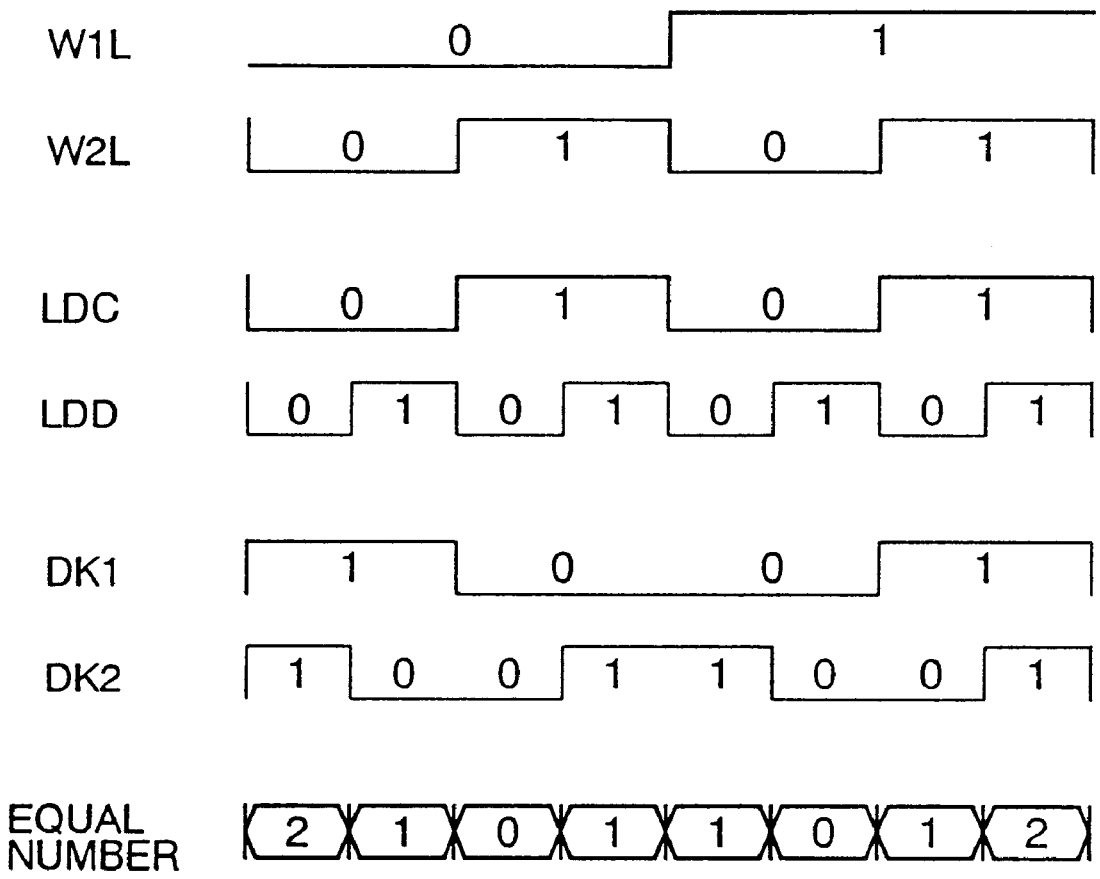
FIG. 28 is a diagram for explaining output operation of an operating circuit in FIG. 27.
Figure 29:
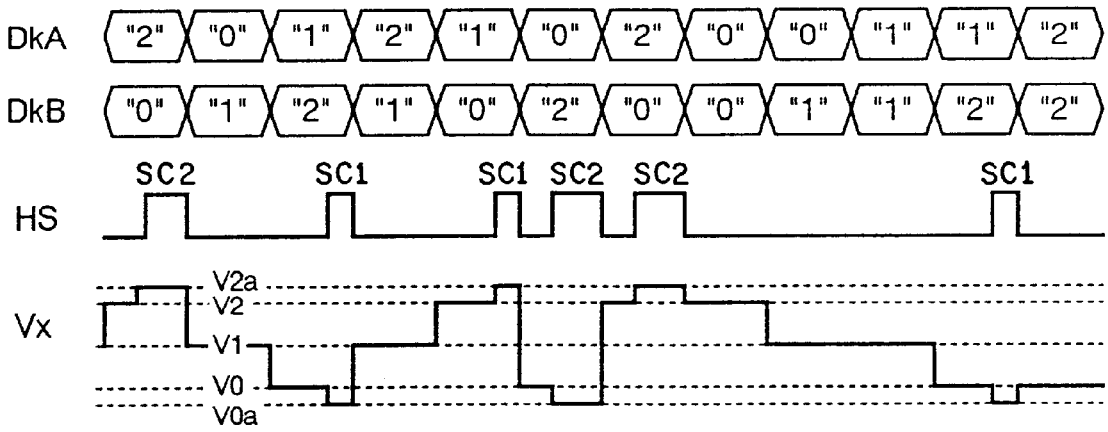
FIG. 29 is a diagram for explaining output operation of a comparison circuit and a liquid crystal voltage selector in FIG. 27.
Figure 30:
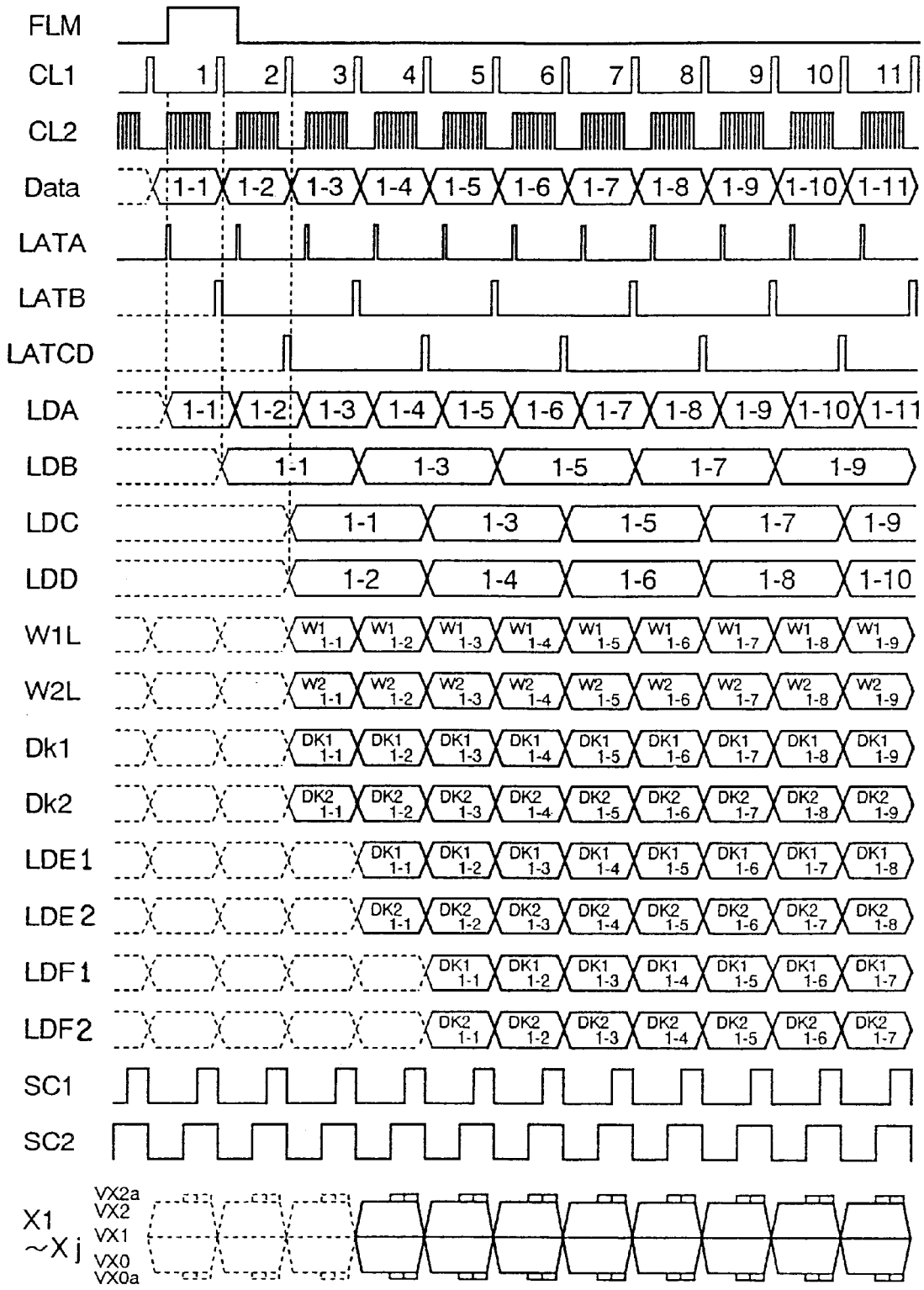
FIG. 30 is a diagram for explaining operation timing of the data driver of FIG. 27.

An example of the data driver 503 of the invention will be described with reference to FIGS. 27 to 30. FIG. 27 is a diagram showing the construction of the data driver 503 of the invention. FIGS. 28 and 29 are diagrams for explaining the operation of the data driver 503. FIG. 30 is a timing chart of the operation of the data driver 503.

As shown in FIG. 27, the data driver 503 comprises a latch address selector 701, a clock control circuit 702, an input data latch circuit A 703, line data latch circuits B704, C705, and D706, an orthogonal function latch circuit 707, an arithmetic circuit 708, data latch circuits E709 and F710, a liquid crystal voltage decoder 711, a comparison circuit 712, a liquid crystal voltage selector 713, and liquid crystal voltage output terminals X1 to Xj. The data driver drives all of the elements by a low voltage of about 5V.

The latch address selector 701 is a circuit for generating a data fetch signal LATA_ received by the input data latch circuit A 703 and is reset by the line clock CL1 signal 506. The signal LATA_ is generated in accordance with the count value of the data latch clock CL2 signal 505.

The clock control unit 702 generates a latch clock LATB of the data latch circuit B and a latch clock LATCD of the data latch circuits C and D from the CL1 signal 506 and the head line clock FLM signal 507. The latch clock is reset by the FLM signal 507. When the CL1 signal 506 is in an odd-number line, LATB is outputted. When the CL1 signal 506 is in an even-number line, LATCD is outputted.

The input data latch circuit A 703 is a circuit for fetching the display data D7 to D0 by the data fetch signal LATA_ generated by the latch address selector 701. The data latch circuit B 704 is a circuit for latching display data outputted from the data latch circuit A 703 every two lines by LATB generated by the clock control circuit 702. The data latch circuit C 705 and the data latch circuit D 706 are circuits for latching display data outputted from the data latch circuit A 703 and the data latch circuit B 704 every two lines by LATCD generated by the clock control circuit 702 and for transmitting the output to the arithmetic circuit 708.

The orthogonal function latch circuit 707 latches the orthogonal function W1 signal 511 and the orthogonal function W2 signal 512 supplied from the scanning driver 502 by the CL1 signal 506 so as to obtain output synchronization with the scanning driver 502.

The arithmetic circuit 708 is constructed by arithmetic circuits of the number corresponding to the number of voltage output terminals. As shown in FIG. 28, each of the arithmetic circuits compares the output values LDC and LDD of the data latch circuit C 705 and the data latch circuit D 706 with the orthogonal function W1L signal and the orthogonal function W2L signal latched by the orthogonal function latch circuit 707 by a coincidence circuit and generates the detected coincidence number as 2-bit coincidence number data DK1 and DK2. The coincidence number data DK1 and DK2 are latched by the data latch circuits E 709 and F 710 in response to the CL1 signal 506 in order to obtain output synchronization. When the display "off" control signal DISPOFF signal 508 is "0", the coincidence number data DK1 and DK2 are forcedly set to "1" and "0", respectively.

The data latch circuit F 710 latches the outputs DK1 and DK2 of the data latch circuit E 709 in response to the CL1 signal 506, holds DK1 and DK2 for one horizontal period, and outputs DK1L and DK2L.

The comparison circuit 712 compares the outputs LDE1 and LDE2 of the data latch circuit E 709 with the outputs LDF1 and LDF2 of the data latch circuit F 710 and outputs a comparison result signal HS having the relation shown in FIG. 29. That is, when it is explained by DKA expressed by LDF1 and LDF2 and DKB expressed by LDE1 and LDE2, the output HS is low when (DKA, DKB)=(0, 0) (1, 1) (2, 2) and (0, 1) (2, 1). When (DKA, DKB)=(2, 0) (0, 2), SC2 is outputted. When (DKA, DKB)=(1, 0) (1, 2), SC1 is outputted.

The liquid crystal voltage decoder 711 and the liquid crystal voltage selector 713 select and output one of the data voltages for driving the liquid crystal at 5 levels in accordance with the coincidence number data LDE1 and LDE2 (shown as DKB) outputted from the data latch circuit 709 and the output HS of the comparison circuit 712. For example, as shown in FIG. 29, in the case where the coincidence number data DKB is "0", when HS is low, the Vx2 voltage 805 is selected. When HS is high, the Vx2a voltage 808 is selected. In the case where the coincidence number data DKB is "2", when HS is low, the Vx0 voltage 807 is selected. When HS is high, the Vx0a voltage 809 is selected. In the case where the coincidence number data DKB is "1", the Vx1 voltage 806 is selected irrespective of HS.

The operation timing of the data driver 503 having the above construction is shown in FIG. 30 and will be described.

The latch address selector 701 is reset by the line clock CL1 signal and generates LATA_ in accordance with the count value of the data latch clock CL2 signal. The clock control circuit 702 generates LATB to be outputted in an odd-number line and LATCD to be outputted in an even-number line as clocks each having a cycle of two lines in response to the FLM signal and the CL1 signal. The data latch circuit A 703 fetches the display data D7 to D0 in response to the data fetch signal LATA_ and outputs LDA. The data latch circuit B 704 latches LDA every two lines in response to LATB and outputs LDB. The data latch circuits C 705 and D 706 are circuits for latching LDA and LDB every two lines in response to LATCD, respectively and sending the outputs LDC and LDD to the arithmetic circuit 708. The arithmetic circuit 708 compares LDC and LDD with the latched orthogonal function W1L signal and the W2L signal in response to the CL1 signal by the coincidence circuit and outputs the detected coincidence number as 2-bit coincidence number data DK1 and DK2. The coincidence number data DK1 and DK2 are latched by the CL1 signal in the data latch circuit E 709 in order to obtain output synchronization and the resultant data is outputted as LDE1 and LDE2 (shown as DKB in FIG, 29). Further, LDE1 and LDE2 are latched by the data latch circuit F 710 in response to the CL1 signal and outputted as LDF1 and LDF2 (shown as DKA in FIG. 29).

The comparison circuit 712 compares the output DKB of the data latch circuit E 709 with the output DKA of the data latch circuit F 710 and outputs a signal HS indicative of the result of the comparison. The liquid crystal voltage decoder 711 and the liquid crystal voltage selector 713 select one of the data voltages at five levels for driving the liquid crystal in accordance with the coincidence number data LDE1 and LDE2 outputted from the data latch circuit 709 and the output HS of the comparison circuit 712. For example, as shown in FIG. 29, in the case where the coincidence number data DKB is "0", the Vx2 voltage 805 is selected when HS is low and the Vx2a voltage 808 is selected when HS is high. In the case where the coincidence number data DKB is "2", the Vx0 voltage 807 is selected when HS is low and the Vx0a voltage 809 is selected when HS is high. When the coincidence number data DkB is "1", the Vx1 voltage 806 is selected irrespective of HS.

Figure 31:
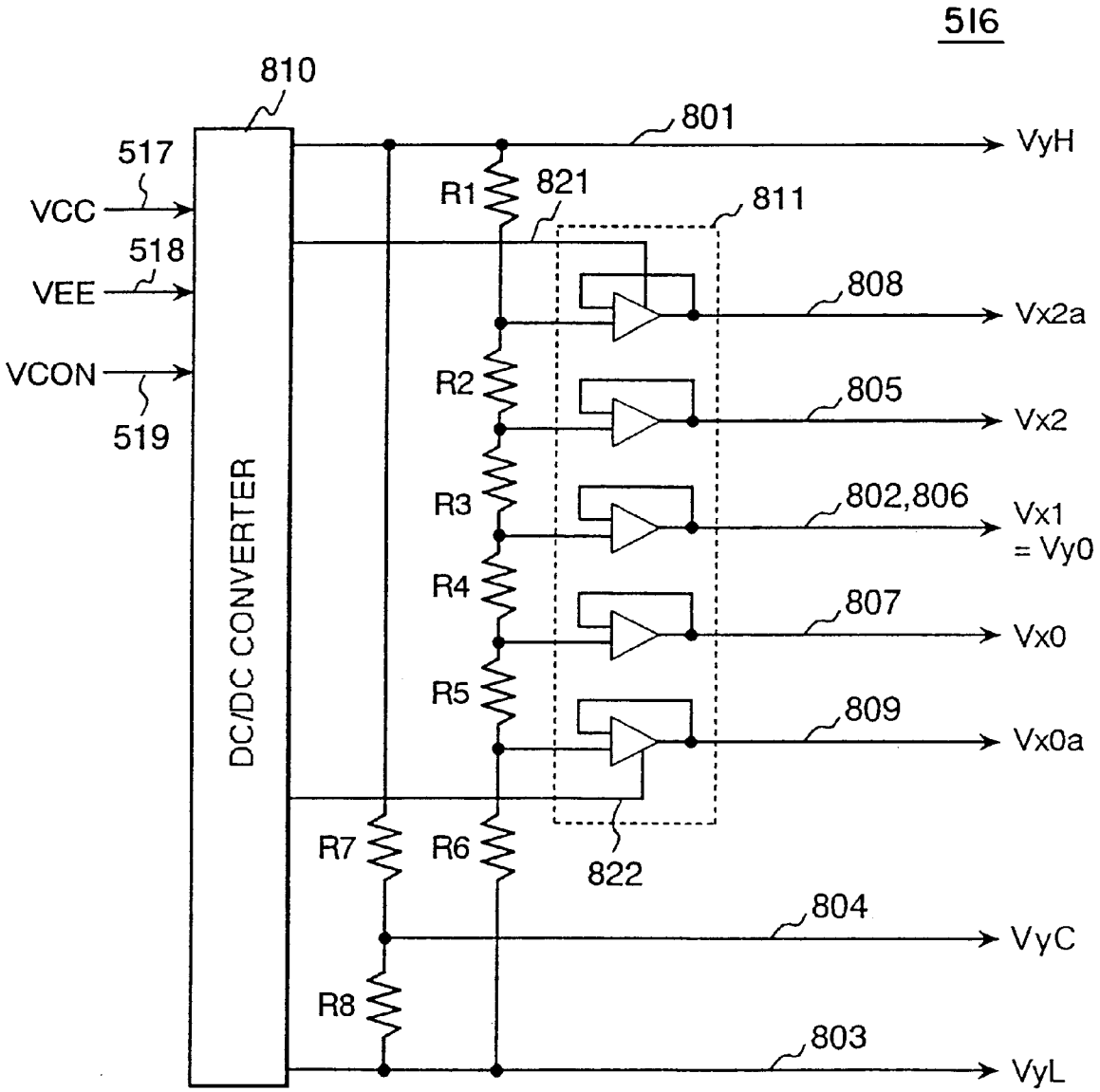
FIG. 31 is a diagram illustrating the construction of a power supply in FIG. 22.

An example of the power supply 516 of the invention will be described with reference to FIG. 31. FIG. 31 is a diagram showing the construction of the power supply 516 and relates to a case where the difference between the data voltages Vx2 and Vx0 for driving the liquid crystal is 5[V] or lower. As shown in FIG. 31, the power supply 516 has a DC-DC converter 810 driven by VCC (5V), voltage dividing resistors R1 to R8, and an operational amplifier 811. Reference numerals 801 to 804 are scanning driver power source voltages VyH, Vy0, VyL, and VyC which are supplied to the scanning driver 502 of the invention. Reference numerals 805 to 809 are data voltages for driving the liquid crystal Vx2, Vx1, Vx0, Vx2a, and Vx0a which are supplied to the data driver 503 of the invention.

The scanning driver power source voltage VyH 801, the VyL voltage 803, and the voltages 821 and 822 for driving the operational amplifier are directly generated by the DC-DC converter 810. Among them, the VyH voltage 801 and the VyL voltage 802 can be varied by the adjustment voltage VCON.

The data voltages 805 to 809 which are supplied to the data driver 503, the scanning Vy0 voltage 802 for driving the liquid crystal, and the scanning driver power source VyC voltage 804 are generated by dividing the voltage between the scanning driver power source VyH voltage 801 and the VyL voltage 803 with the resistors R1 to R6 or R7 and R8.

The resistors R1 to R6 have the following relations.

$$R1=R6$$

$$R2=R5$$

$$R3=R4$$

The voltages have the following relations.

$$VyH>Vy0>VyL$$

$$VyH-Vy0=Vy0-VyL$$

$$Vx2a>Vx2>Vx1>Vx0>Vx0a$$

$$Vx2a-Vx1=Vx1-Vx0a$$

$$Vx2-Vx1=Vx1-Vx0$$

$$Vx2a-Vx2=Vx0-Vx0a=\Delta V$$

$$Vy0=Vx1$$

$$VyC-VyL=5[V]\pm 10\%$$

It is necessary to always keep the relation of VyC−VyL= 5[V] ±10% so as to operate the internal logic circuit of the scanning driver normally. In order to realize it, it is necessary to consider an adjustment width of VyH and VyL by the resistance ratio of R5 and R6 and VCON. The potential difference between the Vx2 voltage 805 and the Vx0 voltage 807 is given by the equation 2 and the potential difference between the VyH voltage 801 and the VyL voltage 803 is given by the equation 3. The data voltages 805 to 809 for driving the liquid crystal and the scanning Vy0 voltage 802 for driving the liquid crystal are subjected to impedance conversion by a voltage follower circuit using the operational amplifier 811. The operational amplifier 811 has the operational amplifier power sources 821 and 822. The value of the voltage adjustment amount ΔV is obtained by conversion from parameters such as wiring resistance of the liquid crystal display panel, the electrostatic capacity of the liquid crystal, the driver on-resistance, drive frequency, and the like.

FIG. 21 shows all of the scanning electrode driving voltages and the data electrode driving voltages of the liquid crystal display of the invention described above. The scanning driver 512 generates the orthogonal functions W1 and W2 shown in FIG. 24 by the FLM signal and the CL1 signal, selects one of the scanning voltages VyL, Vy0, and VyH for driving the liquid crystal at 3 levels in accordance with the combination of the line selection signal generated by the internal scanning line selector and the orthogonal functions W1 and W2 (orthogonal functions WL1 and WL2 from the orthogonal function latch 604), and outputs the selected voltage. On the other hand, the data driver 503 compares the display data of two lines with the orthogonal functions, selects one of the data voltages Vx2, Vx1, and Vx0 for driving the liquid crystal at 3 levels in accordance with the result of the comparison, and outputs the selected voltage. In two continuous horizontal periods, when the voltage level changes during the former horizontal period to the latter horizontal period, the data driver operates so that the voltage level changes in the latter horizontal period in accordance with the voltage change level. That is, since the output of the data driver described as "X background" changes from the Vx1 level in the second horizontal period to the Vx0 level in the third horizontal period, the output changes from the Vx0 level to the Vx0a level synchronously with SC1 during the third horizontal period. Further, since the output of the data driver described as "pattern part" changes from the Vx1 level in the second horizontal period to the Vx2 level in the third horizontal period, the output changes from the Vx2 level to the Vx2a level during the third horizontal period synchronously with SC1. Since the output of the data driver described as "pattern part" changes from the Vx2 level in the fifth horizontal period to the Vx0 level in the sixth horizontal period, the output changes from the Vx0 level to the Vx0a level synchronously with SC2 during the sixth horizontal period. When the output of the data driver in the previous horizontal period and the present output of the data driver change differently, voltage waveform distortion occurs due to the electrostatic capacity of the liquid crystal and the resistance of components such as wiring. Consequently, since the effective value of the voltage applied to the liquid crystal cell is reduced by the distortion amount, means for shifting the voltage level in order to compensate for the reduction in the effective value is employed.

Although the output voltage level is shifted to correct the effective value of the voltage when the output of the data driver changes from Vx1 to Vx0, from Vx1 to Vx2, from Vx0 to Vx2, and from Vx2 to Vx0, the invention is not limited to this correction. For example, a method of changing the output voltage level only when the output of the data driver changes from Vx1 to Vx2 and from Vx0 to Vx2 in order to correct the voltage effective value may be also used. In this case, the level of the voltage is corrected only on the Vx2 side. Since the liquid crystal voltage selector in the data driver is a selector of a type which selects one of the Vx2, Vx1, Vx0, and Vx2a voltages at four levels, the circuit scale of the data driver can be reduced. According to the method, with respect to the correction amount of the voltage level in the omitted correction of the changes from Vx1 to Vx0 and from Vx2 to Vx0, the orthogonal functions are set in a cycle of a few frames, so that the correction amount can be synchronized with the timing changes from Vx1 to Vx2 and from Vx0 to Vx2. Consequently, the correction voltage value per time (one horizontal period) is larger than that of the fifth embodiment. The voltage level correction can be realized by adjusting the pulse width of SC1 and SC2 which determine the amplitude ($\Delta V$) of the correction voltage and the pulse width of the comparison result signal HS.

Two types of the embodiments are separately explained above, that is, the embodiment reducing the shadowing the lateral direction due to the dielectric constant anisotropy, and the other embodiment reducing the shadowing in the vertical direction due to the difference in the waveform distortion of the data voltage. It is possible to use crystal display reducing the shadowing both the lateral and vertical direction. In the case, data driver 103 in FIG. 3 is replaced by data driver 503 shown in FIG. 22.

As mentioned above, according to the invention, the liquid crystal display in which a display quality is improved by using the method of driving a plurality of scan electrodes in the passive matrix display type liquid crystal display panel and reducing the shadowing in the lateral direction due to the dielectric constant anisotropy can be provided.

According to the invention, in the method of simultaneously driving a plurality of lines as a method of driving the passive matrix liquid crystal, the shadowing in the vertical direction due to the difference in the waveform distortion of the data voltage can be reduced and the display quality can be improved.

In the conventional technique, the effective value of the output voltage of the data driver in the display pattern having many change points in the waveform of the data voltage and that in the display pattern having a small number of change points of the waveform of the data voltage are different, and as a result, the shadowing occurs in the vertical direction of the display. On the other hand, according to the invention, when the output voltage of the data driver changes, the correction voltage according to the change is applied. A predetermined voltage effective value can be kept even when the data voltage changes. Consequently, the shadowing can be reduced.

What is claimed is:

1. A liquid crystal display comprising:

a liquid crystal display panel including a plurality of scanning electrodes, a plurality of data electrodes which cross the scanning electrodes, and a plurality of liquid crystal cells at points where the data electrodes cross the scanning electrodes;

a scanning voltage driver which applies respective selective scanning voltages to scanning electrodes in each of a plurality of groups of scanning electrodes one group at a time, each of the groups including M ones of the scanning electrodes of the liquid crystal display panel, M being an integer of 2 or greater, the respective selective scanning voltages applied to the M scanning electrodes in each group being selected from two selective scanning voltages having positive and negative polarities relative to a non-selective scanning voltage in accordance with M orthogonal function data respectively corresponding to the M scanning electrodes in the group; and a data voltage driver which applies respective data voltages to the data electrodes, the data voltage applied to each of the data electrodes being selected from M+1 data voltages in accordance with a coincidence number for the data electrode representing a number of respective coincidences between values of M display data for the data electrode respectively corresponding to the M scanning electrodes in a current group of scanning electrodes to which the selective scanning voltages are currently being applied and values of the M orthogonal function data respectively corresponding to the M scanning electrodes in the current group of scanning electrodes to which the selective scanning voltages are currently being applied;

wherein the data voltage driver, for each of the data electrodes, compares the coincidence number for the data electrode corresponding to the current group of scanning electrodes to which the selective scanning voltages are currently being applied with a coincidence number for the data electrode corresponding to a previous group of scanning electrodes to which the selective scanning voltages were previously applied, controls a correction period in which a correction voltage is to be applied to the data electrode in accordance with a result of the comparison, and applies to the data electrode during the correction period a corrected data voltage which is equal to a sum of the correction voltage and one of the M+1 data voltages.

2. A liquid crystal display according to claim 1, wherein the scanning voltage driver simultaneously applies the respective selective scanning voltages to the M scanning electrodes in the current group of scanning electrodes.

3. A liquid crystal display according to claim 1, wherein the correction period in which a correction voltage is to be applied to the data electrode is defined by a width of a pulse of a comparison result signal which is generated in accordance with a result of the comparison between the coincidence number for the data electrode corresponding to the current group of scanning electrodes with the coincidence number for the data electrode corresponding to the previous group of scanning electrodes.

4. A liquid crystal display according to claim 1, wherein the data voltage driver includes a latch which holds the coincidence number for the data electrode corresponding to the previous group of scanning electrodes.

5. A liquid crystal display comprising:

a liquid crystal display panel including a plurality of scanning electrodes, a plurality of data electrodes which cross the scanning electrodes, and a plurality of liquid crystal cells at points where the data electrodes cross the scanning electrodes;

a scanning voltage driver which applies respective selective scanning voltages to scanning electrodes in each of a plurality of groups of scanning electrodes one group at a time, each of the groups including M adjacent ones of the scanning electrodes of the liquid crystal display panel, M being an integer of 2 or greater, the respective selective scanning voltages applied to the M adjacent scanning electrodes in each group being selected from a plurality of selective scanning voltages in accordance with M orthogonal function data respectively corresponding to the M adjacent scanning electrodes in the group; and a data voltage driver which applies respective data voltages to the data electrodes, the data voltage applied to each of the data electrodes being selected from M+1 data voltages in accordance with a coincidence number for the data electrode representing a number of respective coincidences between values of M display data for the data electrode respectively corresponding to the M adjacent scanning electrodes in a current group of scanning electrodes to which the selective scanning voltages are currently being applied and values of the M orthogonal function data respectively corresponding to the M adjacent scanning electrodes in the current group of scanning electrodes to which the selective scanning voltages are currently being applied;

wherein the data voltage driver, for each of the data electrodes, controls a correction period in which a correction voltage is to be applied to the data electrode in accordance with a value of a difference between (1) the coincidence number for the data electrode corresponding to the current group of scanning electrodes to which the selective scanning voltages are currently being applied and (2) a coincidence number for the data electrode corresponding to a previous group of scanning electrodes to which the selective scanning voltages were previously applied, and applies to the data electrode during the correction period a corrected data voltage which is equal to a sum of the correction voltage and one of the M+1 data voltages.

6. A liquid crystal display according to claim 5, wherein the scanning voltage driver simultaneously applies the respective selective scanning voltages to the M adjacent scanning electrodes in the current group of scanning electrodes.

7. A liquid crystal display according to claim 5, wherein the data voltage driver includes a latch which holds the coincidence number for the data electrode corresponding to the previous group of scanning electrodes.

* * * * *